US008186289B2

(12) United States Patent
Tokura

(10) Patent No.: US 8,186,289 B2
(45) Date of Patent: May 29, 2012

(54) SEWING MACHINE AND COMPUTER-READABLE MEDIUM STORING CONTROL PROGRAM EXECUTABLE ON SEWING MACHINE

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 546 days.

(21) Appl. No.: 12/379,430

(22) Filed: Feb. 20, 2009

(65) Prior Publication Data

US 2009/0217850 A1 Sep. 3, 2009

(30) Foreign Application Priority Data

Feb. 28, 2008 (JP) ..... 2008-047010

(51) Int. Cl.
*D05B 21/00* (2006.01)

(52) U.S. Cl. ..... 112/102.5; 112/470.06

(58) Field of Classification Search ..... 700/136–138; 112/102.5, 470.01, 470.06, 475.19
See application file for complete search history.

(56) References Cited

U.S. PATENT DOCUMENTS

| | | | | |
|---|---|---|---|---|
| 4,998,489 | A * | 3/1991 | Hisatake et al. | 112/470.06 |
| 5,095,835 | A | 3/1992 | Jernigan et al. | |
| 5,537,946 | A | 7/1996 | Sadeh et al. | |
| 5,764,809 | A | 6/1998 | Nomami et al. | |
| 5,838,837 | A | 11/1998 | Hirosawa et al. | |
| 5,911,182 | A * | 6/1999 | Uyama et al. | 112/102.5 |
| 6,101,265 | A | 8/2000 | Bacus et al. | |
| 6,272,235 | B1 | 8/2001 | Bacus et al. | |
| 6,407,745 | B1 | 6/2002 | Yamada et al. | |
| 6,640,004 | B2 | 10/2003 | Katayama et al. | |
| 7,164,786 | B2 | 1/2007 | Katayama et al. | |
| 7,848,842 | B2 | 12/2010 | Suzuki et al. | |
| 2004/0085447 | A1 | 5/2004 | Katta et al. | |
| 2011/0146553 | A1 * | 6/2011 | Wilhelmsson et al. | 112/102.5 |

FOREIGN PATENT DOCUMENTS

| | | |
|---|---|---|
| EP | 0 920 211 A2 | 6/1999 |
| JP | A 61-76188 | 4/1986 |
| JP | A-61-173391 | 8/1986 |
| JP | A-01-286683 | 11/1989 |
| JP | A-2-57288 | 2/1990 |
| JP | A-05-108819 | 4/1993 |

(Continued)

OTHER PUBLICATIONS

Feb. 14, 2012 Office Action mailed in Japanese Application No. 2008-047010 (with English Translation).

*Primary Examiner* — Nathan Durham
(74) *Attorney, Agent, or Firm* — Oliff & Berridge, PLC

(57) ABSTRACT

A sewing machine includes an embroidery frame moving device that moves an embroidery frame holding a work cloth, an image pickup device that picks up images of an upper surface of a bed portion of the sewing machine, a position information storage device that stores position information indicating predetermined positions to which the embroidery frame is to be moved, a partial image acquisition device that causes the embroidery frame moving device to move the embroidery frame to the respective predetermined positions indicated by the position information, causes the image pickup device to pick up images at the respective predetermined positions, and acquires the images picked up by the image pickup device as partial images, and a composite image generation device that generates a composite image by combining the partial images acquired by the partial image acquisition device.

15 Claims, 20 Drawing Sheets

FOREIGN PATENT DOCUMENTS

| | | |
|---|---|---|
| JP | A-05-118997 | 5/1993 |
| JP | A-6-327867 | 11/1994 |
| JP | A-07-066964 | 3/1995 |
| JP | A-07-135605 | 5/1995 |
| JP | A-08-024464 | 1/1996 |
| JP | A-08-071287 | 3/1996 |
| JP | A-9-176955 | 7/1997 |
| JP | A-09-305796 | 11/1997 |
| JP | A 10-5465 | 1/1998 |
| JP | A-11-164292 | 6/1999 |
| JP | A-11-348659 | 12/1999 |
| JP | A-2002-052283 | 2/2002 |
| JP | A-2002-123817 | 4/2002 |
| JP | A-2002-131033 | 5/2002 |
| JP | A-2004-088678 | 3/2004 |
| JP | A-2007-289653 | 11/2007 |

* cited by examiner

FIG. 7

621

| EMBROIDERY FRAME COORDINATE STORAGE AREA | | |
|---|---|---|
| IMAGE NO. | EMBROIDERY FRAME COORDINATES | |
| | x | y |
| 1 | +35 | -30 |
| 2 | -23 | -28 |
| 3 | +33 | +28 |
| 4 | -30 | +25 |

FIG. 8

631

| PARTIAL IMAGE STORAGE AREA | |
|---|---|
| IMAGE NO. | PARTIAL IMAGE |
| 1 | |
| 2 | |
| 3 | |
| 4 | |

FIG. 9

632

| WORLD COORDINATE STORAGE AREA | | | | | | | |
|---|---|---|---|---|---|---|---|
| IMAGE NO. | WORLD COORDINATES | | | | | | |
| 1 | | | v | | | | |
| | | | 1 | | 2 | | ··· |
| | | | $X_w$ | $Y_w$ | $X_w$ | $Y_w$ | ··· |
| | u | 1 | | | | | ··· |
| | | 2 | | | | | ··· |
| | | ⋮ | ⋮ | ⋮ | ⋮ | ⋮ | ⋮ |
| 2 | | | v | | | | |
| | | | 1 | | 2 | | ··· |
| | | | $X_w$ | $Y_w$ | $X_w$ | $Y_w$ | ··· |
| | u | 1 | | | | | ··· |
| | | 2 | | | | | ··· |
| | | ⋮ | ⋮ | ⋮ | ⋮ | ⋮ | ⋮ |
| 3 | | | v | | | | |
| | | | 1 | | 2 | | ··· |
| | | | $X_w$ | $Y_w$ | $X_w$ | $Y_w$ | ··· |
| | u | 1 | | | | | ··· |
| | | 2 | | | | | ··· |
| | | ⋮ | ⋮ | ⋮ | ⋮ | ⋮ | ⋮ |
| 4 | | | v | | | | |
| | | | 1 | | 2 | | ··· |
| | | | $X_w$ | $Y_w$ | $X_w$ | $Y_w$ | ··· |
| | u | 1 | | | | | ··· |
| | | 2 | | | | | ··· |
| | | ⋮ | ⋮ | ⋮ | ⋮ | ⋮ | ⋮ |

FIG. 10

633

| CORRESPONDING COORDINATE STORAGE AREA | | | | | | | | | | | |
|---|---|---|---|---|---|---|---|---|---|---|---|
| | | y | | | | | | | | | |
| | | 1 | | | 2 | | | ··· | width | | |
| | | IMAGE NO. | WORLD COORDINATES | | IMAGE NO. | WORLD COORDINATES | | ··· | IMAGE NO. | WORLD COORDINATES | |
| | | | $X_w$ | $Y_w$ | | $X_w$ | $Y_w$ | | | $X_w$ | $Y_w$ |
| x | 1 | 1 | | | 1 | | | ··· | 1 | | |
| | 2 | 1 | | | 1 | | | ··· | 1 | | |
| | ⋮ | ⋮ | | | ⋮ | | | ··· | ⋮ | | |
| | height | 4 | | | 4 | | | ··· | 4 | | |

FIG. 11

634

| COMPOSITE IMAGE STORAGE AREA | | | | | |
|---|---|---|---|---|---|
| | | y | | | |
| | | 1 | 2 | ··· | width |
| x | 1 | | | ··· | |
| | 2 | | | ··· | |
| | ⋮ | ⋮ | ⋮ | ⋮ | ⋮ |
| | height | | | ··· | |

SEWING MACHINE AND COMPUTER-READABLE MEDIUM STORING CONTROL PROGRAM EXECUTABLE ON SEWING MACHINE

CROSS-REFERENCE TO RELATED APPLICATION

This application claims priority to Japanese Patent Application No. 2008-047010, filed Feb. 28, 2008, the content of which is hereby incorporated herein by reference in its entirety.

BACKGROUND

The present disclosure relates to a sewing machine. More particularly, the present disclosure relates to a sewing machine equipped with a camera and a computer-readable medium storing control program executable on the sewing machine.

Conventionally, a sewing machine has been proposed which is equipped with a camera to pick up an image of a needle drop point and the vicinity of the needle drop point. In a sewing machine described in Japanese Laid-Open Patent Publication Nos. H8-24464 and H8-71287, an image of the vicinity of the needle drop point is picked up and the picked-up image is displayed on a display device which is provided in the sewing machine to enable a user to confirm a needle drop point and a sewn state. An imaging range of such a camera disposed on the sewing machine is limited. Therefore, such a camera can pick up an image of only the needle drop point and the vicinity of the needle drop point.

SUMMARY

The user may desire to obtain not only an image of a needle drop point and the vicinity of the needle drop point but also an image of a wider range. In such a case, a wide-angle lens or a fish-eye lens may be used. Alternatively, a plurality of cameras may be disposed and images that are picked up by the respective cameras may be combined. In a case where the wide-angle lens or the fish-eye lens is used, an image of a wider range may be obtained. However, the obtained image may have a lower in resolution than an image that is picked up by a camera with a standard lens. In a case where the images that are picked up by the plurality of cameras are combined, distortion may occur at an peripheral portion of the image, resulting in a slight mismatch at a boundary between the images to be combined. An extra cost may occur in a case where the plurality of cameras are disposed.

Various exemplary embodiments of the broad principles derived herein provide a sewing machine that generates an image of a wide range by using a simple and inexpensive structure and a computer-readable medium storing a control program executable on the sewing machine.

Exemplary embodiments provide a sewing machine that includes an embroidery frame moving device that moves an embroidery frame holding a work cloth, an image pickup device that picks up images of an upper surface of a bed portion of the sewing machine, a position information storage device that stores position information indicating predetermined positions to which the embroidery frame is to be moved, a partial image acquisition device that causes the embroidery frame moving device to move the embroidery frame to the respective predetermined positions indicated by the position information, causes the image pickup device to pick up images at the respective predetermined positions, and acquires the images picked up by the image pickup device as partial images, and a composite image generation device that generates a composite image by combining the partial images acquired by the partial image acquisition device.

Exemplary embodiments provide a computer-readable medium storing a control program executable on a sewing machine. The program includes instructions that cause a controller to perform the steps of moving an embroidery frame holding a work cloth to respective predetermined positions which are indicated by position information and to which the embroidery frame is to be moved, acquiring images picked up at the respective predetermined positions as partial images, and generating a composite image by combining the partial images acquired.

Other objects, features, and advantages of the present disclosure will be apparent to persons of ordinary skill in the art in view of the following detailed description of embodiments of the invention and the accompanying drawings.

BRIEF DESCRIPTION OF THE DRAWINGS

Exemplary embodiments will be described below in detail with reference to the accompanying drawings in which:

FIG. 7 is a schematic diagram showing a configuration of an embroidery frame coordinate storage area;

FIG. 8 is a schematic diagram showing a configuration of a partial image storage area;

FIG. 9 is a schematic diagram showing a configuration of a world coordinate storage area;

FIG. 10 is a schematic diagram showing a configuration of a corresponding coordinate storage area;

FIG. 11 is a schematic diagram showing a configuration of a composite image storage area;

DETAILED DESCRIPTION OF THE EXEMPLARY EMBODIMENTS

Figure 1:
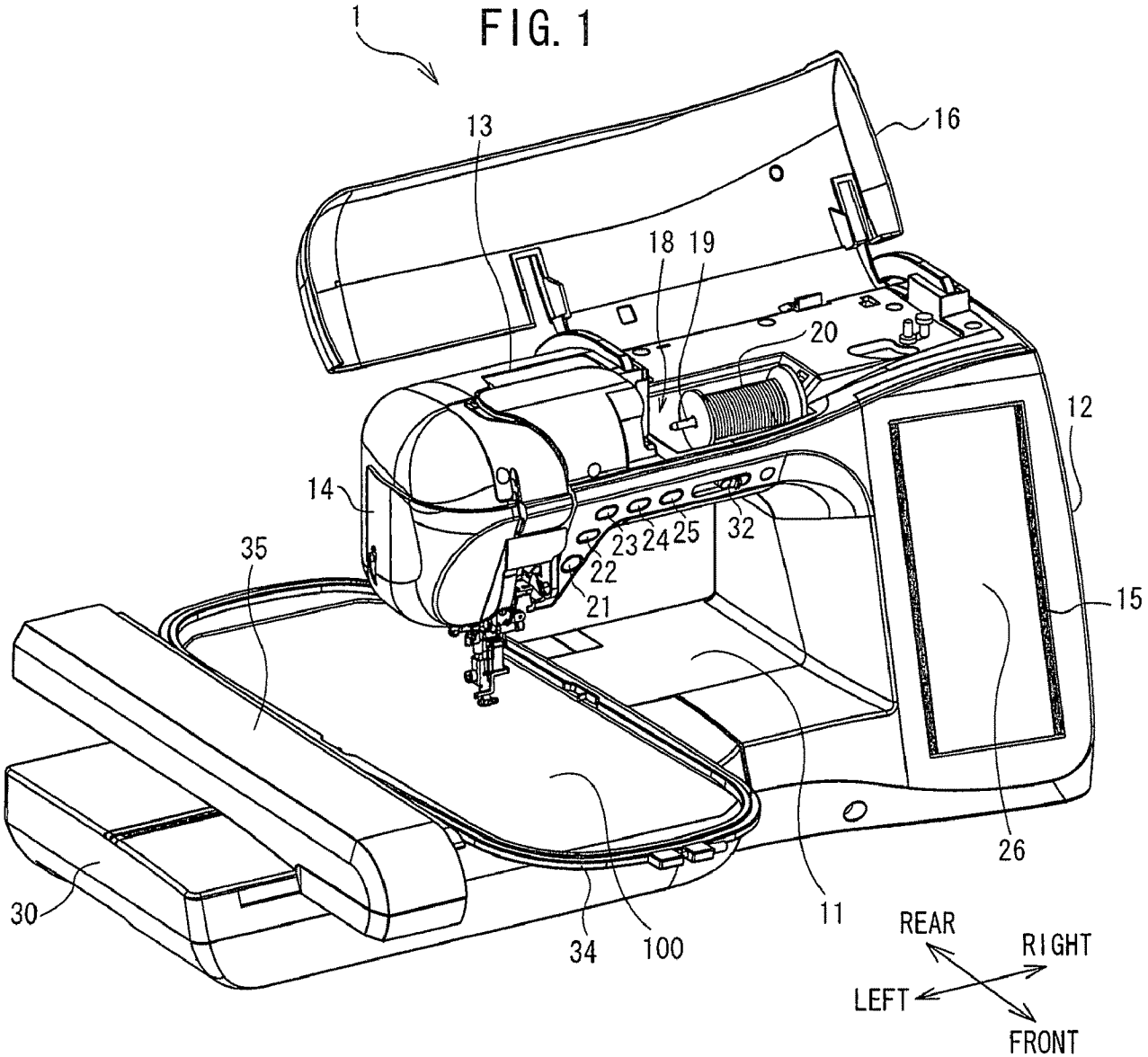
FIG. 1 is a perspective view of a sewing machine that can sew an embroidery pattern.

The following will describe embodiments of the present disclosure with reference to the drawings. First, the configuration of a sewing machine 1 will be described below with reference to FIGS. 1 and 2. The side of the page that faces toward a user of the sewing machine 1 in FIG. 1 is referred to as the front side, and the side that faces away from the user is referred to as the rear side. The side at which the pillar 12 is positioned is referred to as the right side and the opposite side thereof is referred to as the left side.

As shown in FIG. 1, the sewing machine 1 includes a sewing machine bed 11, a pillar 12, an arm 13, and a head 14. The sewing machine bed 11 extends in the right-and-left direction. The pillar 12 is erected at the right end portion of the sewing machine bed 11. The arm 13 extends leftward from the upper end portion of the pillar 12. The head 14 is provided at the left end portion of the arm 13. The sewing machine bed 11 is equipped with a needle plate (not shown), a feed dog (not shown), a cloth feed mechanism (not shown), a feed adjustment pulse motor 78 (see FIG. 6), and a shuttle mechanism (not shown). The needle plate is disposed on the upper surface of the sewing machine bed 11. The feed dog is provided under the needle plate and feeds by a predetermined feed distance a work cloth that is to be sewn. A cloth feed mechanism drives the feed dog. The feed adjustment pulse motor 78 adjusts a feed distance.

An embroidery unit 30 may be attached to the left of the sewing machine bed 11. An embroidery frame 34, in which a work cloth 100 may be set, can be attached to and detached from the embroidery unit 30. An area inside the embroidery frame 34 provides an embroidery area in which stitches of an embroidery pattern can be sewn. A carriage cover 35 that extends in the front-and-rear direction is provided at the upper portion of the embroidery unit 30. A Y-axis movement mechanism (not shown) is disposed under the carriage cover 35. The Y-axis movement mechanism is used to move in a Y-direction (front-and-rear direction) a carriage (not shown) that the embroidery frame 34 can be attached to and detached from. The Y-axis movement mechanism drives the carriage so that the embroidery frame 34 may be moved in the Y direction. The right end portion (not shown) of the carriage protrudes rightward from the right side surface of the carriage cover 35. A guide 341 (see FIG. 5) that is provided at the left side of the embroidery frame 34 can be attached to and detached from the right end portion of the carriage. The carriage, the Y-axis movement mechanism, and the carriage cover 35 are driven by an X-axis movement mechanism (not shown) so as to be moved in an X-axis direction (right-and-left direction). The X-axis movement mechanism is provided in a body of the embroidery unit 30. Thus, the embroidery frame 34 is driven so as to be moved in the X-direction. The X-axis movement mechanism and the Y-axis movement mechanism are driven by an X-axis motor 83 (see FIG. 6) and a Y-axis motor 84 (see FIG. 6), respectively. In a case where a CPU 61 (see FIG. 6) of the sewing machine 1 outputs a command to drive the Y-axis motor and the X-axis motor, the embroidery frame 34 is moved in the X direction and in the Y direction, and a needle bar 6 (see FIG. 2) and the shuttle mechanism (not shown) are also driven. Thus, a pattern such as an embroidery pattern may be sewn on the work cloth 100 that is set in the embroidery frame 34. In a case where a utility stitch pattern is sewn instead of an embroidery pattern, the embroidery unit 30 may be detached from the sewing machine bed 11. The utility stitch pattern is sewn while the feed dog moves the work cloth.

A liquid crystal display (LCD) 15 that is formed in a vertically long rectangular shape is provided on a front surface of the pillar 12. The LCD 15 displays various kinds of information such as various messages for the user, an embroidery pattern setting screen, and a sewing setting screen. The embroidery pattern setting screen is used for arranging and editing an embroidery pattern. The sewing setting screen is used for performing various kinds of settings for sewing. A touch panel 26 is provided on a front surface of the LCD 15. The user touches a position on the touch panel 26 with the user's finger or with a dedicated touch pen to select an area or a key that is displayed at a position on the LCD 15 that corresponds to the touched position on the touch panel 26.

The configuration of the arm 13 will be described below. A top cover 16 is provided at an upper portion of the arm 13 and may be opened and closed. The top cover 16 is provided along the longitudinal direction of the arm 13 and is pivotally supported on the upper rear end portion of the arm 13 so that the top cover 16 may be opened and closed around a right-and-left directional axis. A concaved thread spool housing 18 is provided in the middle upper side of the arm 13 under the top cover 16. The thread spool housing 18 houses a thread spool 20 from which a needle thread is supplied to the sewing machine 1. From the inner wall surface of the thread spool housing 18 on the pillar 12 side, a spool pin 19 protrudes toward the head 14. The thread spool 20 may be attached to the spool pin 19 when the spool pin 19 is inserted through an insertion hole (not shown) formed in the thread spool 20. A needle thread (not shown) extending from the thread spool 20 may pass through a tensioner, a thread take-up spring, and thread hooking portions, such as a thread take-up lever etc. Then, the needle thread may be supplied to a sewing needle 7 (see FIG. 2) attached to the needle bar. The tensioner is provided to the head 14 and adjusts thread tension. The thread take-up lever reciprocates up and down to take up a needle thread. The needle bar 6 is driven by a needle bar up-and-down movement mechanism (not shown) that is provided in the head 14, so as to be moved up and down. The needle bar up-and-down movement mechanism is driven by a drive shaft (not shown), which is rotationally driven by a sewing machine motor 79 (see FIG. 6).

A sewing start/stop switch 21, a reverse stitch switch 22, a needle up/down switch 23, a presser foot up/down switch 24, an automatic threading start switch 25, etc are provided on the lower portion of the front surface of the arm 13. The sewing start/stop switch 21 is used to instruct to start or stop sewing so that operation of the sewing machine 1 may be started or stopped. The reverse stitch switch 22 is used to feed the work cloth in a direction opposite to the normal feed direction, that is, from the rear side to the front side. The needle up/down switch 23 is used to switch the stop position of the needle bar 6 (see FIG. 2) between an upper position and a lower position. The presser foot up/down switch 24 is used to instruct operations to raise and lower a presser foot 47 (see FIG. 2). The automatic threading start switch 25 is used to instruct to start automatic threading for hooking the thread on the thread take-up lever, on the tensioner, and on the thread take-up spring and passing the thread through a needle eye of the sewing needle 7 (see FIG. 2). A speed controller 32 is provided at the midsection of the lower portion of the front surface of the arm 13. The speed controller 32 is used to adjust a speed at which the needle bar 6 is driven up and down, that is, a rotary speed of the drive shaft.

Figure 2:
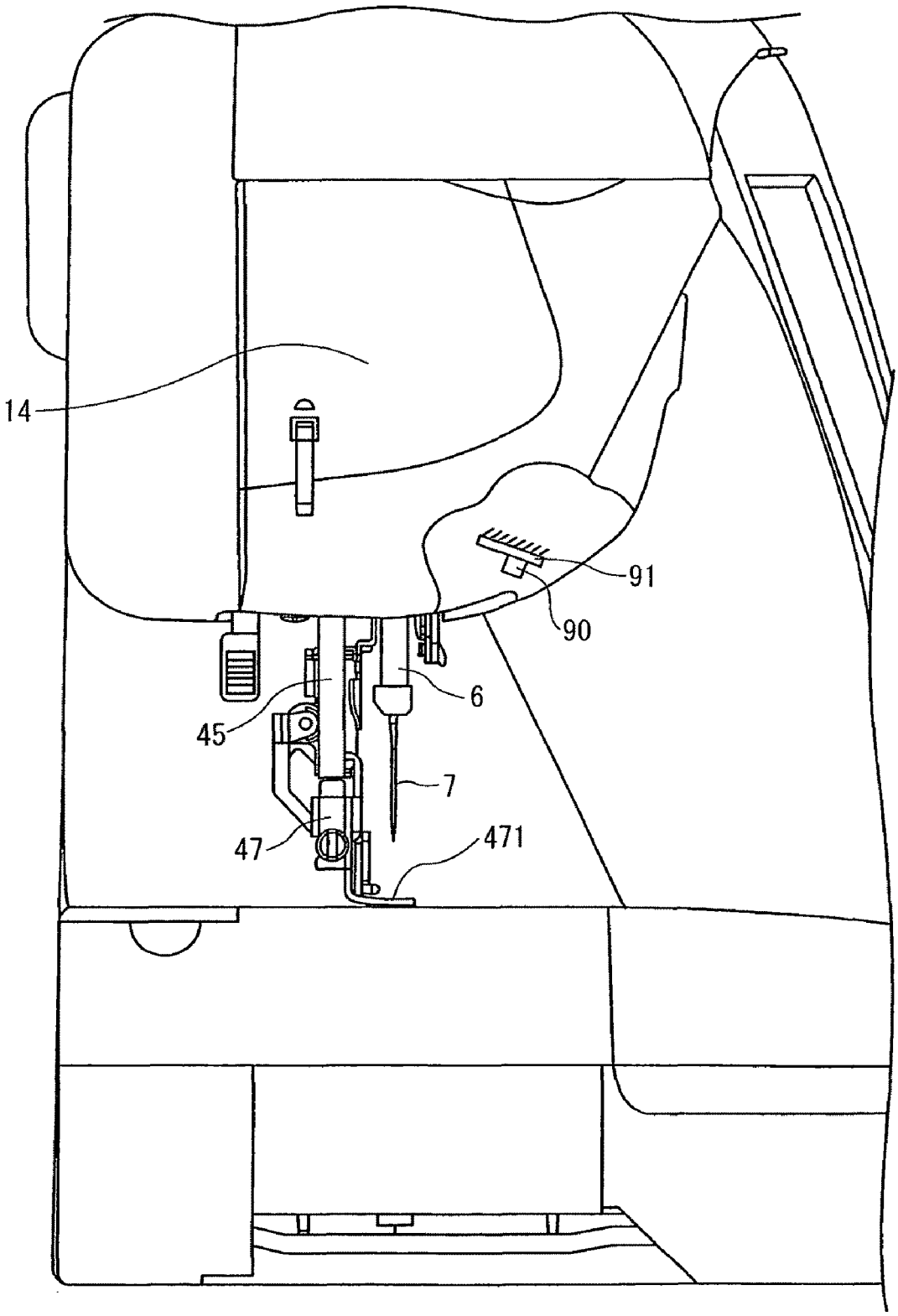
FIG. 2 is a left side view of essential parts of a needle bar, a sewing needle, a presser bar, and a presser foot of the sewing machine, and their vicinities.

Description will be made below as to the needle bar 6, the sewing needle 7, a presser bar 45, and a presser foot 47 and their vicinities with reference to FIG. 2. The needle bar 6 and the presser bar 45 are provided to the lower side of the head 14. The sewing needle 7 may be fixed to the lower end portion of the needle bar 6. The presser foot 47 may be fixed to the lower end portion of the presser bar 45 and may hold down a work cloth. An image sensor 90 is disposed so as to pick up an image of a needle drop point of the sewing needle 7 and an area in its vicinity. A lower end portion 471 of the presser foot 47 is made of a transparent resin so that an image of a work cloth that is placed under the presser foot 47 or stitches on the work cloth can be picked up. The needle drop point refers to a point on a work cloth at which the sewing needle 7 is stuck through the work cloth when moved downward by a needle bar up/down movement mechanism. The image sensor 90 includes a CMOS sensor and a control circuit. The CMOS sensor is used to pick up an image. A small-sized and inexpensive CMOS sensor is used as the image sensor 90, so that an installation space and production costs of the image sensor 90 may be reduced. In the present embodiment, as shown in FIG. 2, a support frame 91 is attached to a frame (not shown) of the sewing machine 1. The image sensor 90 is fixed to the support frame 91.

Figure 3:
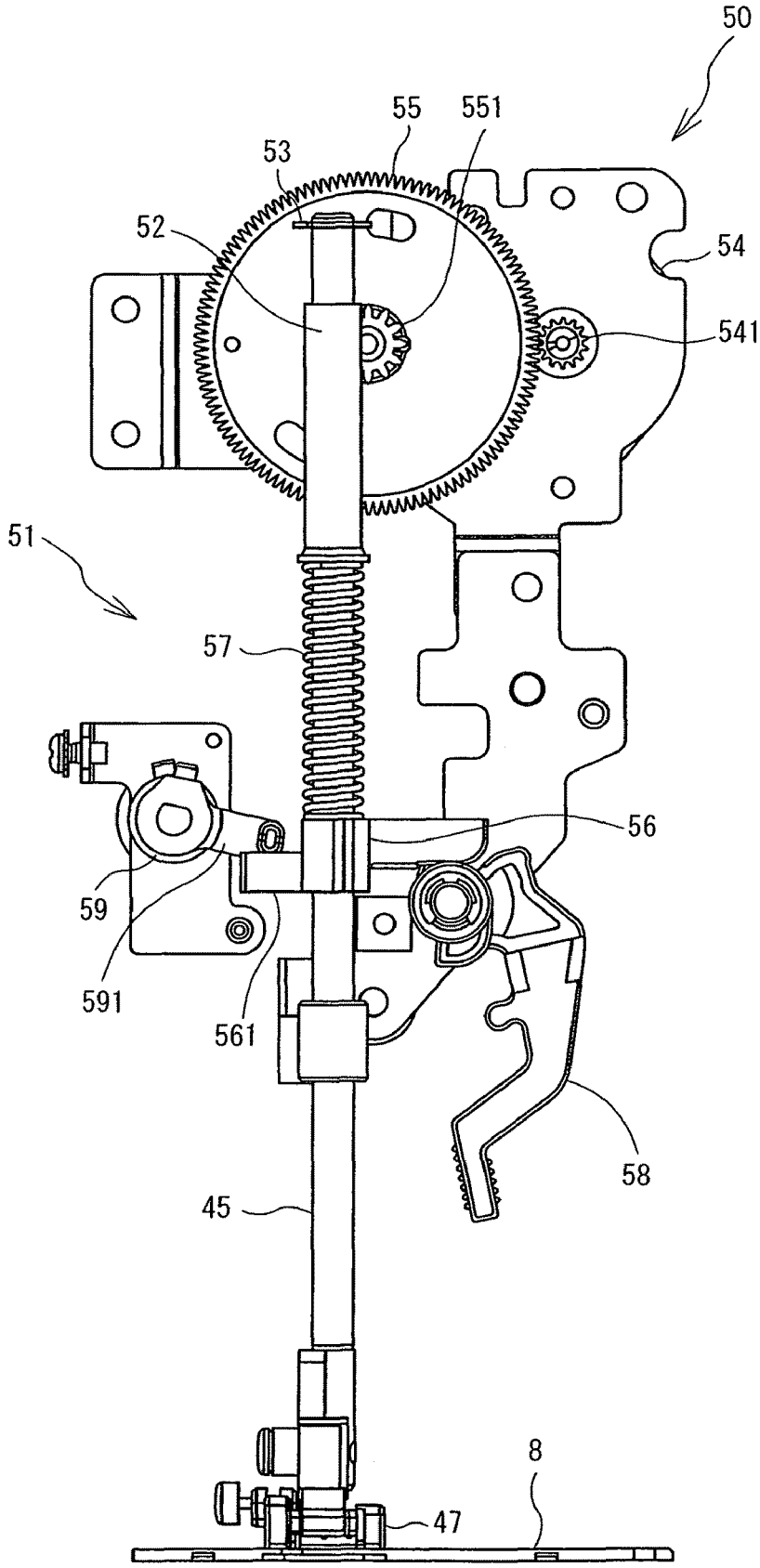
FIG. 3 is a front view of a presser foot lifting device in a condition where a presser foot is at a pressing position.
Figure 4:
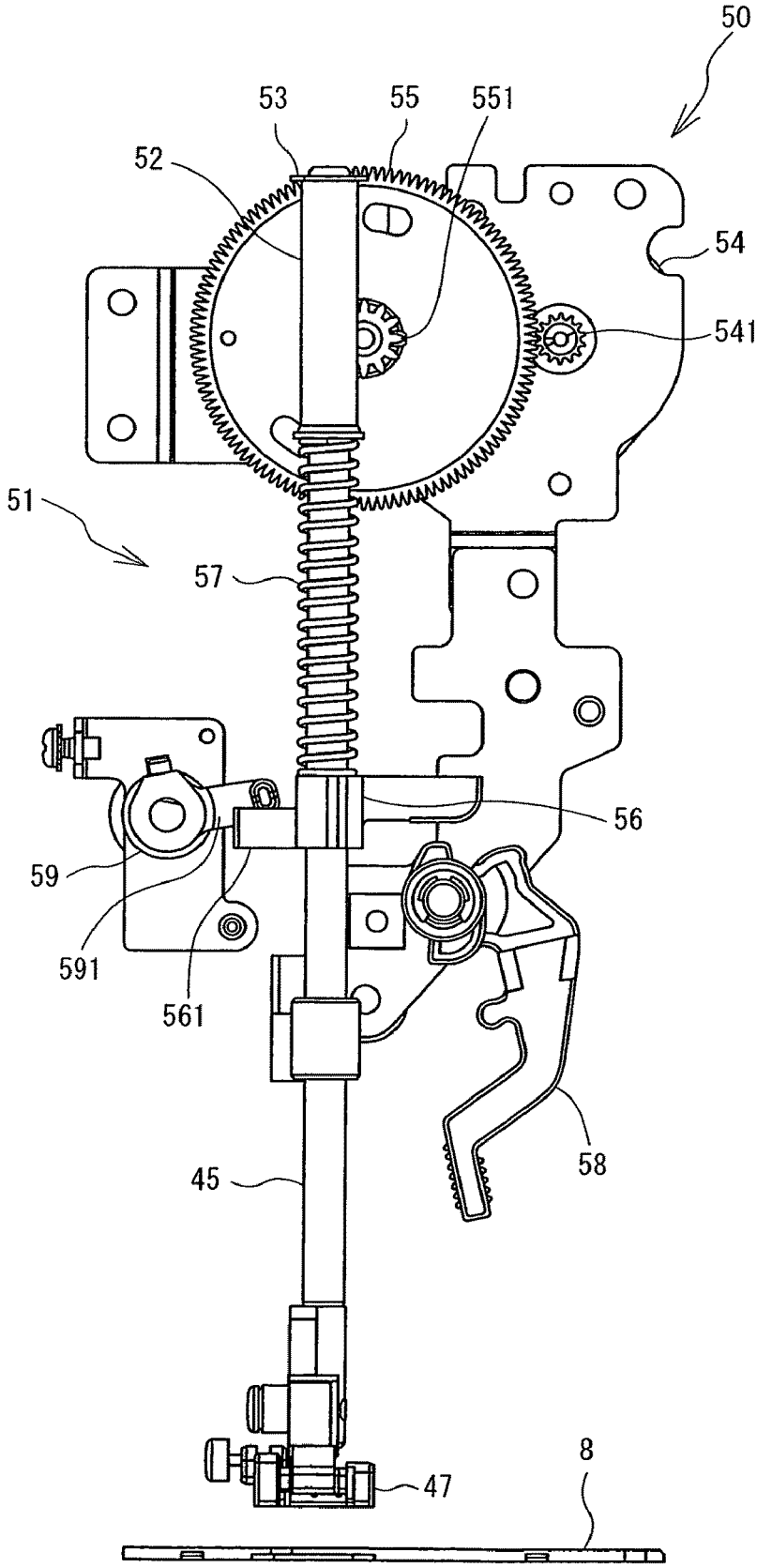
FIG. 4 is a front view of the presser foot lifting device in a condition where the presser foot is at a raised position.

A presser foot lifting device 50 will be described below with reference to FIGS. 3 and 4. The presser foot lifting device 50 is disposed behind the needle bar 6. The presser foot lifting device 50 is used to raise and lower the presser bar 45 and the presser foot 47. The presser bar 45 is supported on a frame of the sewing machine 1 so as to be raised and lowered. The presser foot 47 is attached to a lower end of the presser bar 45. As shown in FIGS. 3 and 4, the presser foot lifting device 50 includes a presser foot lifting mechanism 51 and a presser bar drive stepping motor 54 (actuator), which drives the presser foot lifting mechanism 51. The presser foot 47 shown in FIGS. 3 and 4 is used in utility sewing and has a different shape from the presser foot 47 that is used in embroidery sewing shown in FIGS. 1 and 2. A presser foot 47 suitable for a desired type of sewing may be selected and then attached to the presser bar 45.

The presser foot lifting mechanism 51 includes a rack member 52, a retaining ring 53, a drive gear 541, an intermediate gear 55, a presser bar guide bracket 56, a presser spring 57, and the like. The rack member 52 is externally fitted to an upper portion of the presser bar 45 so as to be raised and lowered. The retaining ring 53 is fixed to the upper end of the presser bar 45. The drive gear 541 is coupled to an output shaft of the presser bar drive stepping motor 54. The intermediate gear 55 meshes with the drive gear 541. The presser bar guide bracket 56 is fixed to an intermediate portion of the presser bar 45. The presser spring 57 is externally mounted to the presser bar 45 between the rack member 52 and the presser bar guide bracket 56. The intermediate gear 55 has a small diameter pinion 551 integrally. The pinion 551 meshes with a rack (not shown) of the rack member 52. A presser bar lifter lever 58 is provided at the right of the presser bar guide bracket 56. The presser bar lifter lever 58 is used for manually raising and lowering the presser bar 45.

If the presser bar drive stepping motor 54 is driven in accordance with a command from the CPU 61, the driving force of the presser bar drive stepping motor 54 is transmitted via a drive gear 541 to the intermediate gear 55 and the pinion 551, thus moving the rack member 52 up and down. A detailed description is given below. In a case where the drive gear 541 is driven clockwise, the intermediate gear 55 rotates counterclockwise to lower the rack member 52. As the rack member 52 is lowered, the presser foot 47 is lowered together with the presser bar 45 via the presser spring 57. As the presser foot 47 is lowered, the lower surface of the presser foot 47 comes in contact with a work cloth (not shown) that is placed on the upper surface of the needle plate 8. As the rack member 52 is further lowered, the presser spring 57 is compressed, as shown in FIG. 3. The work cloth is pressed by the presser foot 47, with a spring force of the presser spring 57. On the other hand, in a case where the drive gear 541 is driven counterclockwise, the intermediate gear 55 rotates clockwise to raise the rack member 52. Then, the upper end of the rack member 52 comes in contact with the retaining wing 53, which is fixed to the upper end of the presser bar 45. Therefore, as the rack member 52 is raised, the presser bar 45 is raised together with the presser foot 47, as shown in FIG. 4.

A potentiometer 59 is provided at the left of the presser bar 45. The potentiometer 59 is used to detect a position in height of the presser foot 47. A lever portion 591, which extends rightward from the rotary shaft of the potentiometer 59, contacts the upper surface of a projecting portion 561, which projects leftward of the presser bar guide bracket 56. In response to the rising and lowering of the presser bar 45 and the presser bar guide bracket 56, the lever portion 591 swings and the rotational shaft rotates, thereby the resistance value of the potentiometer 59 is changed. The CPU 61 can compute the position in height of the presser foot 47 based on the resistance value. A reference position of the presser foot 47 is set to a position in height of the presser foot 47 at the time when the lower surface of the presser foot 47 comes in contact with the upper surface of the needle plate 8. Therefore, the thickness of the work cloth may be detected by detecting the height of the presser foot 47.

Figure 5:
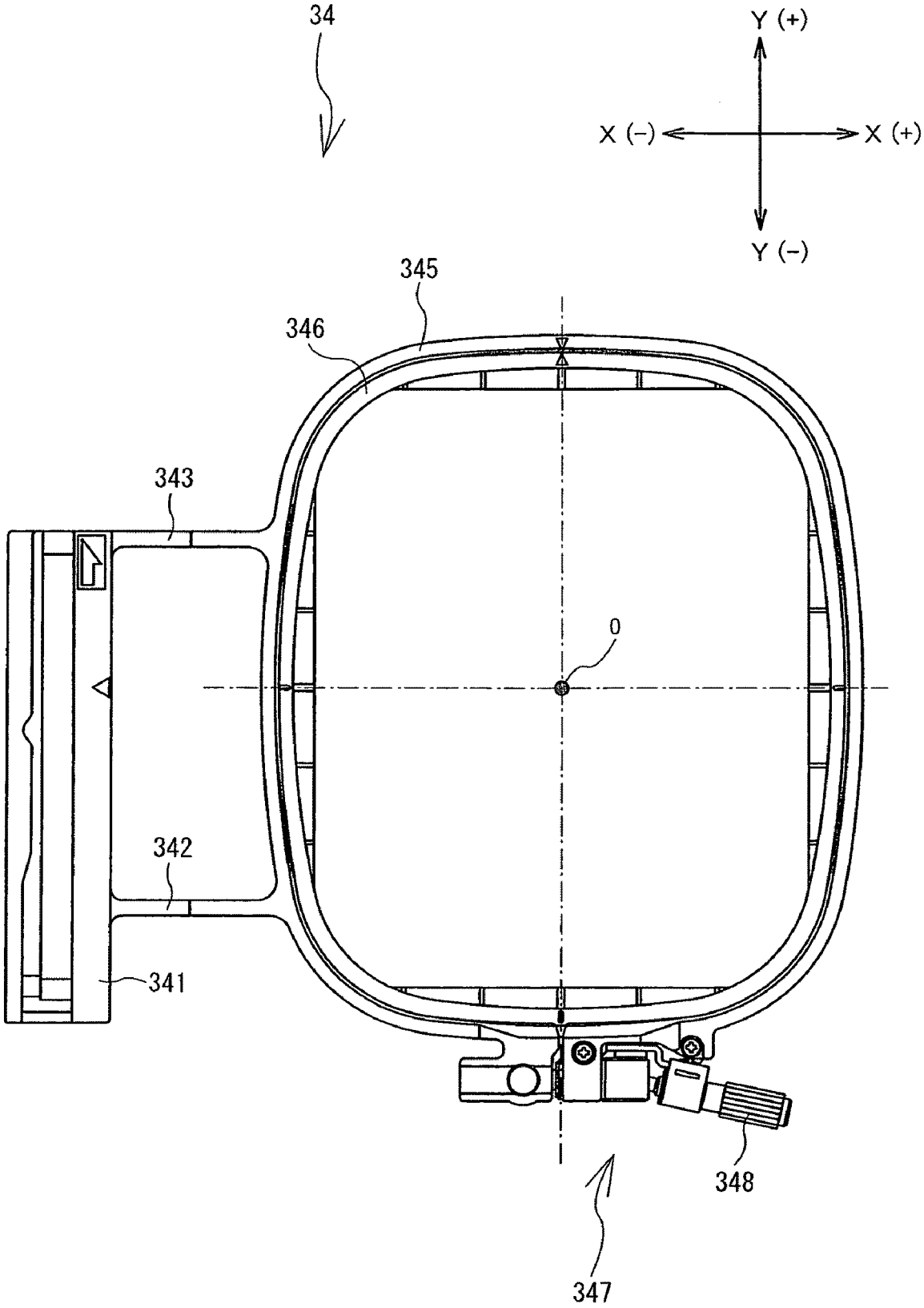
FIG. 5 is a top view of an embroidery frame.

The embroidery frame 34 will be described below with reference to FIG. 5. Support bars 342 and 343, which support an outer frame 345, extend from a guide 341 having a substantially rectangular shape in a planar view. The outer frame 345 has a substantially rectangular shape in a planar view and corners of the outer frame 345 are respectively formed into substantially rectangular shapes. A projecting portion (not shown), which extends in a longitudinal direction, is provided at substantially the middle of the lower surface of the guide 341. The projecting portion may be engaged with an engagement groove (not shown), which is provided at the right end of the carriage of the embroidery unit 30 and extends in the front-and-rear direction, so that the embroidery frame 34 may be attached to the carriage. In this case, the projecting portion is biased by an elastic bias spring (not shown), which is provided on the carriage, in such a direction as to be pressed into the engagement groove. Therefore, the embroidery frame 34 is securely engaged with the carriage without backlash so as to be moved integrally with the carriage. An inner frame 346 is internally fitted into the outer frame 345. The outer periphery of the inner frame 346 is formed substantially in the same shape as the inner periphery of the outer frame 345. The work cloth may be sandwiched between the outer frame 345 and the inner frame, and an adjusting screw 348 of an adjustment mechanism 347, which is provided on the outer frame 345, may be tightened so that the work cloth may be held by the embroidery frame 34. The embroidery frame 34 shown in FIG. 5 is different in size and shape from that shown in FIG. 1. A plurality of types of embroidery frames are prepared which are different in size and shape so that one of the embroidery frames suitable for the size etc. of an embroidery pattern may be selectively used.

Description will be made below as to a coordinate system that indicates a position of the embroidery frame 34. As shown in FIG. 5, the center of an embroidery area of the embroidery frame 34 is taken as a point O. An initial position of the embroidery frame 34 that is set when the embroidery frame 34 is attached to the embroidery unit 30 is such a position that the needle drop point of the sewing needle 7 corresponds to the point O. Coordinates of the point O at the initial position of the embroidery frame 34 are set to be an origin (0,0). In a case where the embroidery frame 34 is moved by the embroidery unit 30, a movement distance is determined for each of an X-axial transfer mechanism and a Y-axial transfer mechanism based on coordinates of the moved point O. A right and left direction of the paper in FIG. 5 is referred to as the X-axial direction, in which the value increases rightward. A up and down direction of the page in FIG. 5 is referred to as the Y-axial direction, in which the value increases upward.

Figure 6:
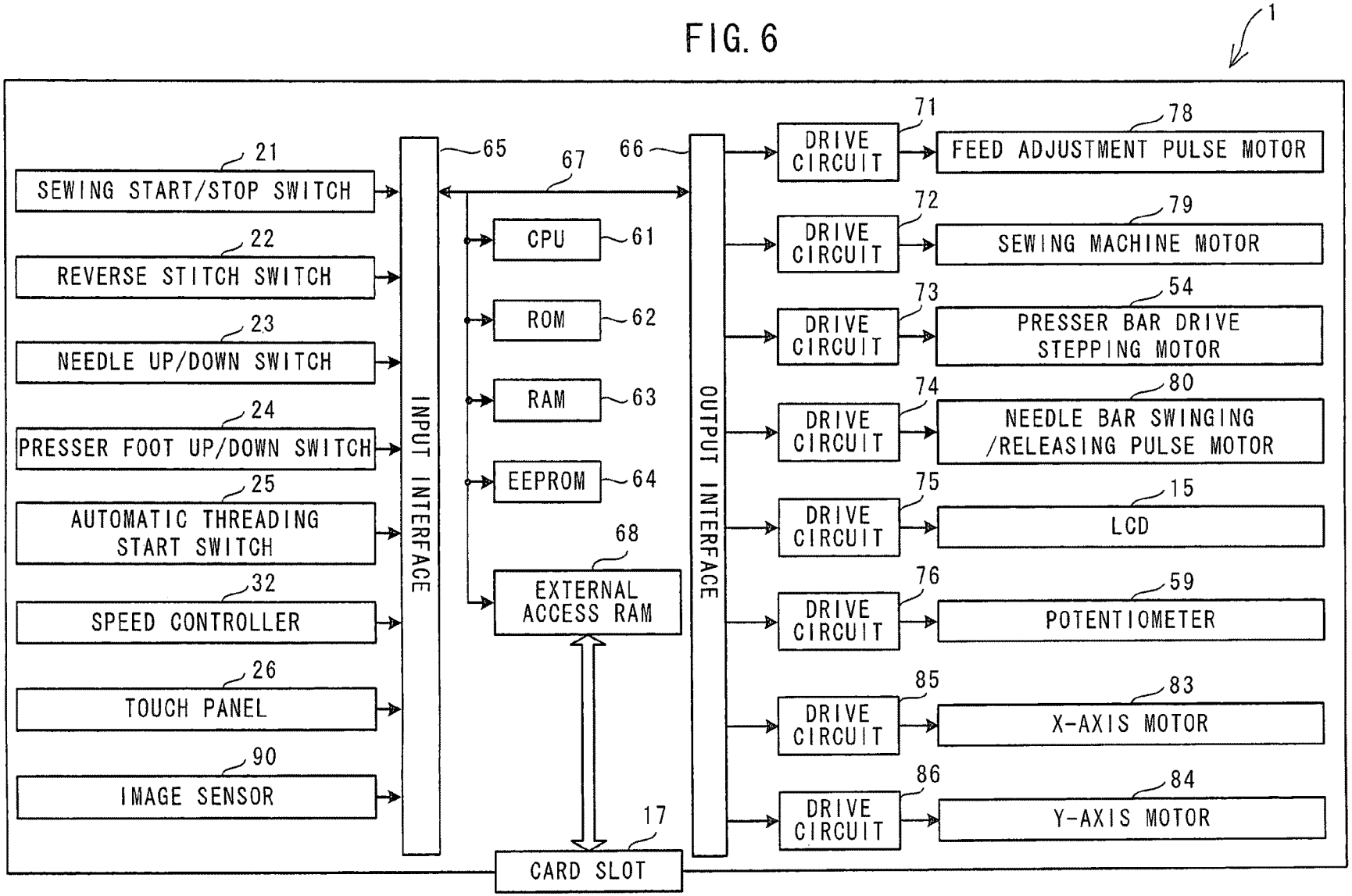
FIG. 6 is a block diagram showing an electrical configuration of the sewing machine.

The electrical configuration of the sewing machine I will be described below with reference to FIG. 6. As shown in FIG. 6, the sewing machine 1 includes a CPU 61, an ROM 62, an RAM 63, an EEPROM 64, a card slot 17, an external access RAM 68, an input interface 65, an output interface 66, and the like, which are mutually connected via a bus 67. Connected to the input interface 65 are the sewing start/stop switch 21, the reverse stitch switch 22, the needle up/down switch 23, the presser foot up/down switch 24, the automatic threading start switch 25, the speed controller 32, the touch panel 26, and the image sensor 90. Drive circuits 71, 72, 73, 74, 75, 76, 85, and 86 are electrically connected to the output interface 66. The drive circuit 71 drives the feed adjustment pulse motor 78. The drive circuit 72 drives the sewing machine motor 79. The drive circuit 73 drives the presser bar drive stepping motor 54. The drive circuit 74 drives a needle bar swinging/releasing pulse motor 80 that swingably drives or releases the needle bar 6. The drive circuit 75 drives the LCD 15. The drive circuit 76 drives the potentiometer 59. The drive circuit 85 drives the X-axis motor 83, which transfers the embroidery frame 34. The drive circuit 86 drives the Y-axis motor 84 that moves the embroidery frame 34.

The CPU 61 performs main control over the sewing machine 1 and performs various kinds of computation and processing in accordance with a control program. The control program is stored in a control program storage area of the ROM 62, which is a read-only memory device. The RAM 63, which is a readable and writable random access memory, includes other storage areas as required for storing the results of the computation and processing performed by the CPU 61.

Description will be made below as to an embroidery frame coordinate storage area 621 and a partial image storage area 631 with reference to FIGS. 7 and 8, respectively. The embroidery frame coordinate storage area 621 is provided in the ROM 62. The partial image storage area 631 is provided in the RAM 63.

As shown in FIG. 7, the embroidery frame coordinate storage area 621 includes data items of an image number and embroidery frame coordinates. The embroidery frame coordinate storage area 621 stores the embroidery frame coordinates that correspond to the image numbers. The embroidery frame coordinates are two-dimensional coordinates (x, y) that indicate a position to which the center point O of the embroidery frame 34 is to be moved when an image of the corresponding image number is picked up. In an example shown in FIG. 7, embroidery frame coordinates corresponding to image numbers 1 to 4 are stored. When an image of the image number "1" is picked up, the center point O is moved to (+35, −30). When an image of the image number "2" is picked up, the center point O is moved to (−23, −28). When an image of the image number "3" is picked up, the center point O is moved to (+33, +28). When an image of the image number "4" is picked up, the center point O is moved to (−30, +25). The respective coordinate values are not limited to the values shown in FIG. 7 but may be changed appropriately.

As shown in FIG. 8, the partial image storage area 631 includes data items of the image number and a partial image. The partial image storage area 631 stores an image that is picked up by the image sensor 90, corresponding to an image number. A partial image may be represented by a two-dimensional array having the same number of elements as the number of pixels of an image that is picked up by the image sensor 90. Pixel values of respective pixels are stored as the partial image. In an example shown in FIG. 8, partial images corresponding to image numbers 1 to 4 are stored. That is, the embroidery frame 34 is moved to coordinates stored as the embroidery frame coordinates in the embroidery frame coordinate storage area 621 shown in FIG. 7, and then an image that is picked up by the image sensor 90 is stored as a partial image in the partial image storage area 631.

Description will be made below as to storage areas included in the RAM 63 that are used to generate a composite image with reference to FIGS. 9 to 11. A world coordinate storage area 632 in the RAM 63 stores $X_W$ coordinates and $Y_W$ coordinates of three-dimensional coordinates in a world coordinate system of respective pixels of a partial image after the partial image is corrected. A corresponding coordinate storage area 633 in the RAM 63 stores $X_W$ coordinates and $Y_W$ coordinates of the three-dimensional coordinates in the world coordinate system, corresponding to respective pixels of the composite image. A composite image storage area 634 in the RAM 63 stores pixel values of the respective pixels of the composite image. The world coordinate system is a three-dimensional coordinate system that is used mainly in the field of three-dimensional graphics and represents the whole of space. The world coordinate system is not influenced by the center of gravity etc. of a subject.

As shown in FIG. 9, the world coordinate storage area 632 includes data items of the image number and world coordinates. The world coordinate storage area 632 stores $X_W$ coordinates and $Y_W$ coordinates of three-dimensional coordinates in the world coordinate system corresponding to the respective pixels of a partial image of an image number. In an example shown in FIG. 9, coordinates that indicate positions of the respective pixels of the partial image are represented by (u, v).

The corresponding coordinate storage area 633 will be described below with reference to FIG. 10. The corresponding coordinate storage area 633 includes two-dimensional arrays having the same number as the number of the pixels of the composite image. Array elements include the image number and $X_W$ coordinates and $Y_W$ coordinates of the three-dimensional coordinates in the world coordinate system. Assuming that the number of vertical pixels and the number of horizontal pixels of the composite image are "height" and "width", respectively, the number of the vertical pixels and the number of the horizontal pixels of the composite image are obtained as height=HEIGHT/scale and width=WIDTH/scale, respectively. "Scale" represents an actual size of each of the pixels of the composite image. "HEIGHT" and "WIDTH" represent the vertical size and the horizontal size of an embroidery area of the embroidery frame, respectively.

The composite image storage area 634 will be described below with reference to FIG. 11. The composite image storage area 634 includes two-dimensional arrays having the same number as the number of the pixels of the composite image. The arrays store the pixel values of the respective pixels.

Description will be made below as to generation of the composite image with reference to FIGS. 12 to 17. In the schematic illustrations of FIGS. 13 to 17, the embroidery frame 34 is illustrated as a simplified rectangle. In a case where a position on the touch panel 26 which corresponds to an image pickup key on an initial menu screen (not shown) which is displayed on the LCD 15 is touched, the CPU 61 executes an image combining program to perform processing shown in FIG. 12. The image combining program is stored in the ROM 62. An instruction of generating the composite image may not be received by accepting an input from the touch panel 26. For example, an image pickup switch may be provided on the arm 13 so that the instruction of generating the composite image may be received by pressing the image pickup switch.

Figure 12:
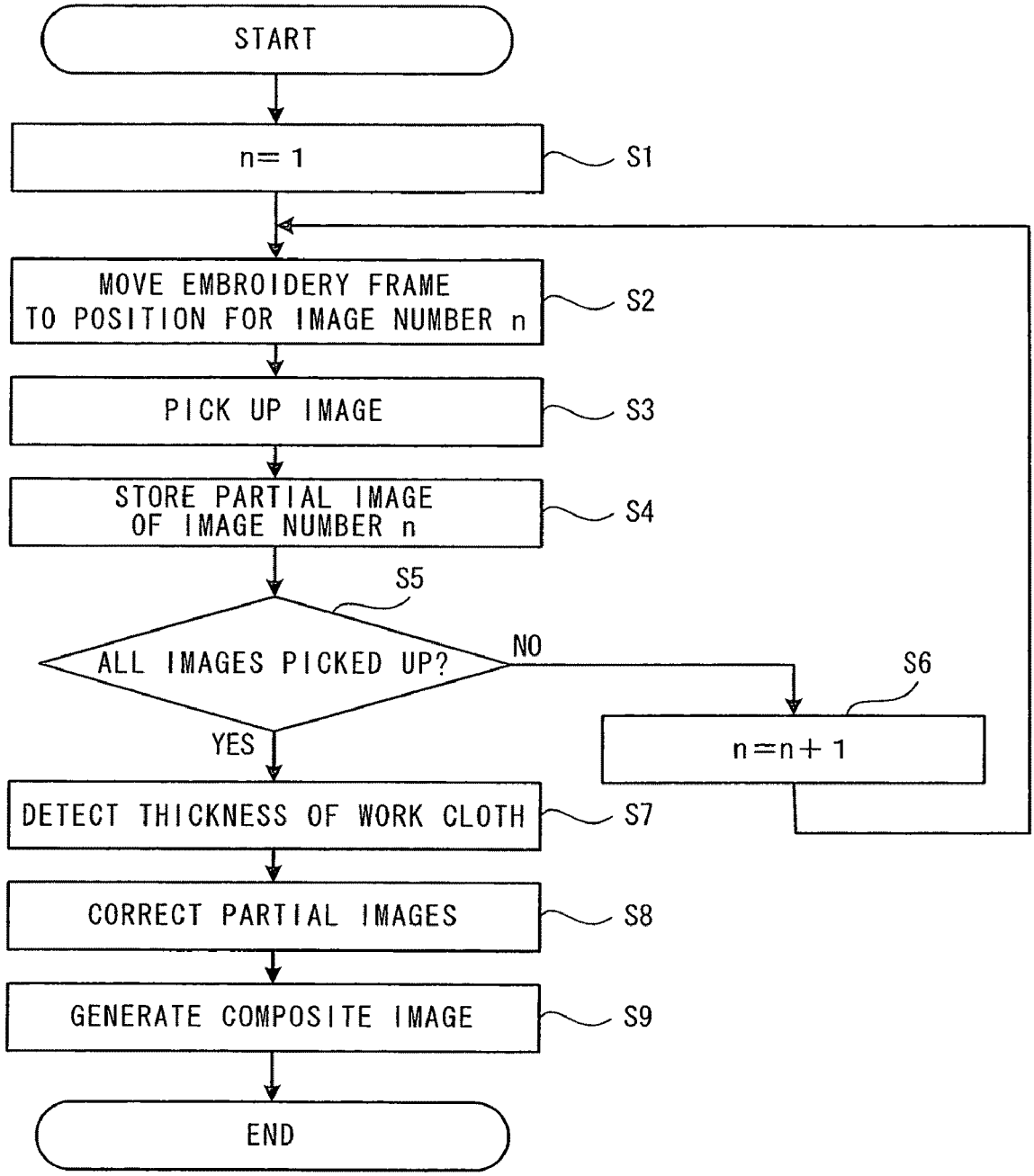
FIG. 12 is a flowchart showing operation of the sewing machine when a composite image is generated.
Figure 13:
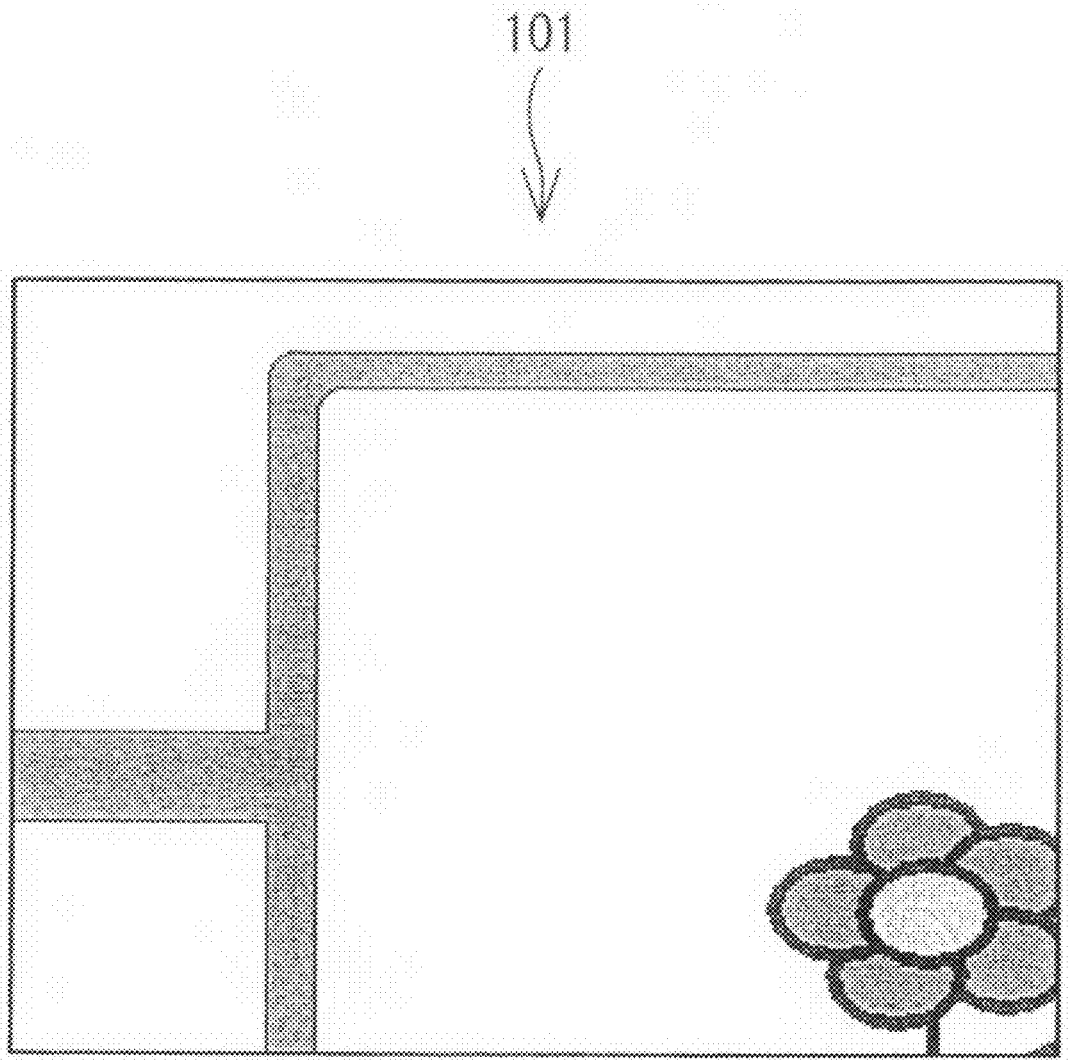
FIG. 13 is a schematic illustration showing a partial image of a left rear portion of an embroidery area.

As shown in FIG. 12, an initial value "1" is set as a variable n (step S1). The variable n indicates the image number of an image to be picked up. The RAM 63 includes a storage area for storing the variable n. Subsequently, the embroidery frame 34 is moved to a position indicated by the coordinates for an image of the image number n in the embroidery frame coordinate storage area 621 (step S2). Specifically, the embroidery frame coordinates are read out which are stored in the embroidery frame coordinate storage area 621 corresponding to the image number with the value of the variable n ("1" in this case). Here, the coordinates (+35, −30) are read out. An instruction for moving the embroidery frame 34 to a position that is indicated by the read out coordinates is outputted to the drive circuits 85 and 86 that drive the X-axial motor 83 and the Y-axial motor 84, respectively. Subsequently, an image is picked up by the image sensor 90 (step S3). Subsequently, the picked up image is stored as a partial image of the image number n ("1" in this case) in the partial image storage area 631 (step S4). A partial image 101 shown in FIG. 13 is an example of a partial image of the image number "1." An example in FIG. 13 is a partial image of a left rear portion of the embroidery area and the embroidery frame 34 in a case where a picture of a flower is laid out at substantially the middle of the embroidery area in the embroidery frame 34.

Subsequently, determination is made as to whether all images that are required to generate a composite image have been picked up (step S5). Specifically, determination is made as to whether the variable n is "4." If the variable n is "4," the images of the image number "1" to "4" have been picked up. That is, all the images have been picked up (YES at step S5). Here, the variable n is "1," so that it is determined that not all of the images are picked up (NO at step S5). Therefore, 1 is added to the variable n, so that the variable n becomes "2" (step S6). Then, the CPU 61 returns to the step of the instruction for moving the embroidery frame 34 (step S2).

Figure 14:
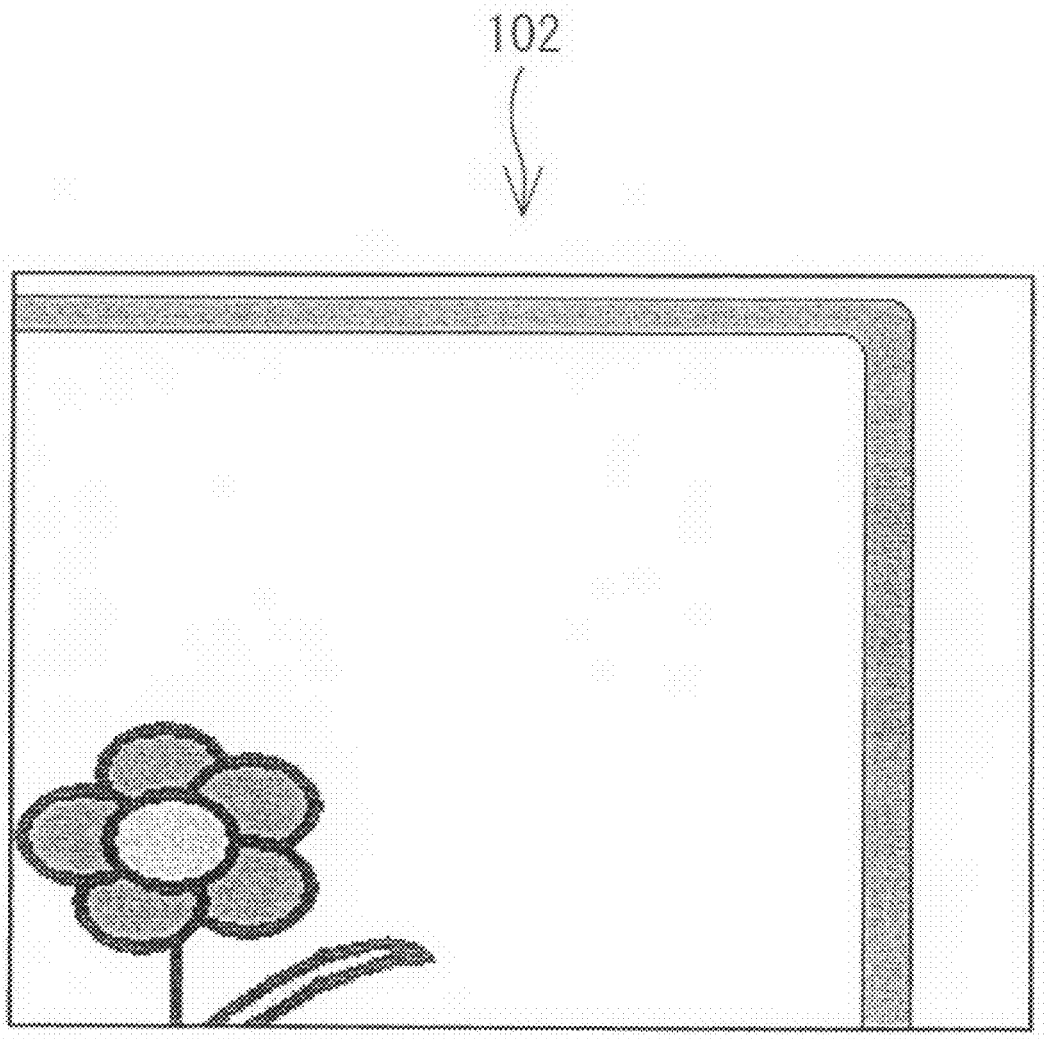
FIG. 14 is a schematic illustration showing a partial image of a right rear portion of the embroidery area.

The embroidery frame 34 is moved to a position for an image of the image number "2" (step S2), and then the image is picked up by the image sensor 90 (step S3). The picked up image is stored as a partial image of the image number "2" in the partial image storage area 631 (step S4). The partial image 102 shown in FIG. 14 is an example of the partial image of the image number "2." The example shown in FIG. 14 is a partial image of a right rear portion of the embroidery area and the embroidery frame 34 in a case where the picture of the flower is arranged at substantially the middle of the embroidery area in the embroidery frame 34. Since the variable n is "2", not all of the images have been picked up yet (NO at step S5). 1 is added to the variable n, so that the variable becomes "3" (step S6). Then, the CPU 61 returns to the step of the instruction for moving the embroidery frame 34 (step S2).

Figure 15:
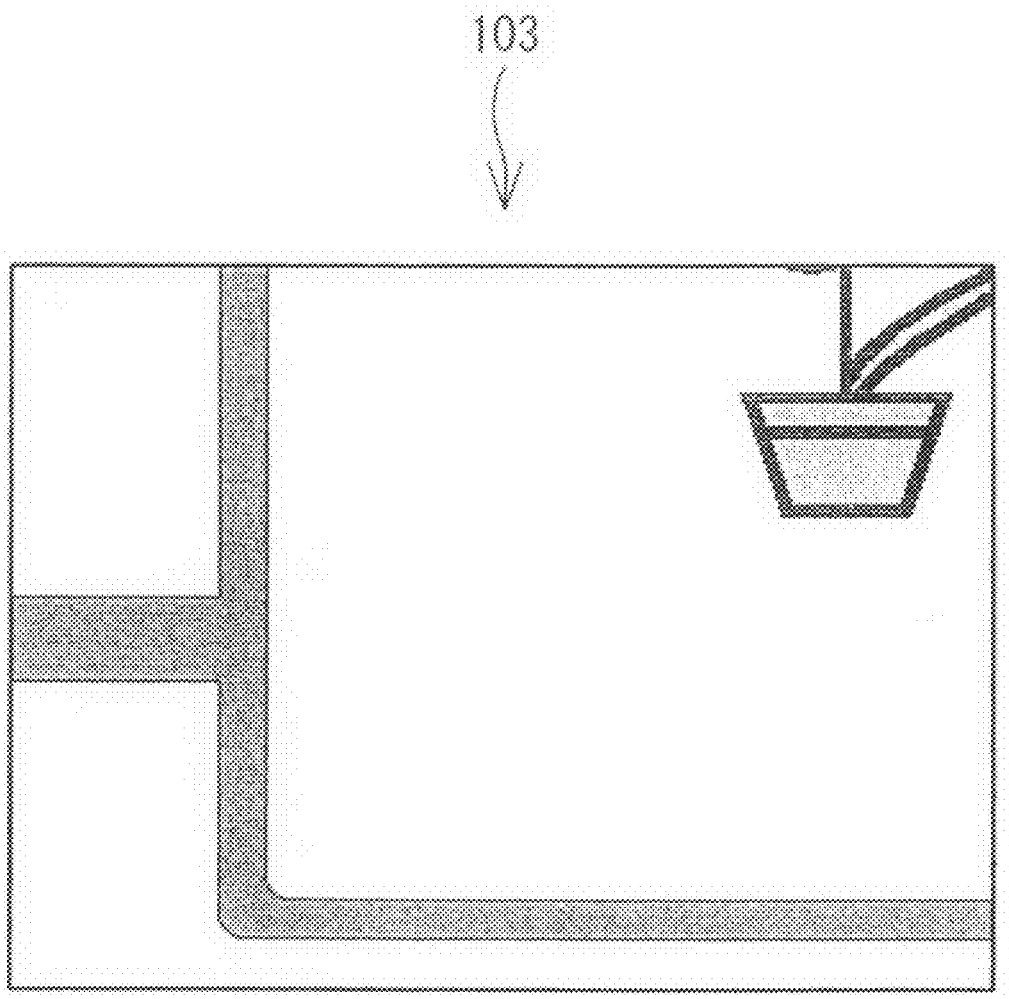
FIG. 15 is a schematic illustration showing a partial image of a left front portion of the embroidery area.

The embroidery frame 34 is moved to a position for an image of the image number "3" (step S2), and then the image is picked up by the image sensor 90 (step S3). The picked up image is stored as a partial image of the image number "3" in the partial image storage area 631 (step S4). The partial image 103 shown in FIG. 15 is an example of the partial image of the image number "3." The example shown in FIG. 15 is a partial image of a left front portion of the embroidery area and the embroidery frame 34 in a case where the picture of the flower is arranged at substantially the middle of the embroidery area in the embroidery frame 34. Since variable n is "3," not all the images have been picked up yet (NO at step S5). 1 is added to variable n, so that the variable becomes "4" (step S6). Then, the CPU 61 returns to the step of the instruction for moving the embroidery frame 34 (step S2).

Figure 16:
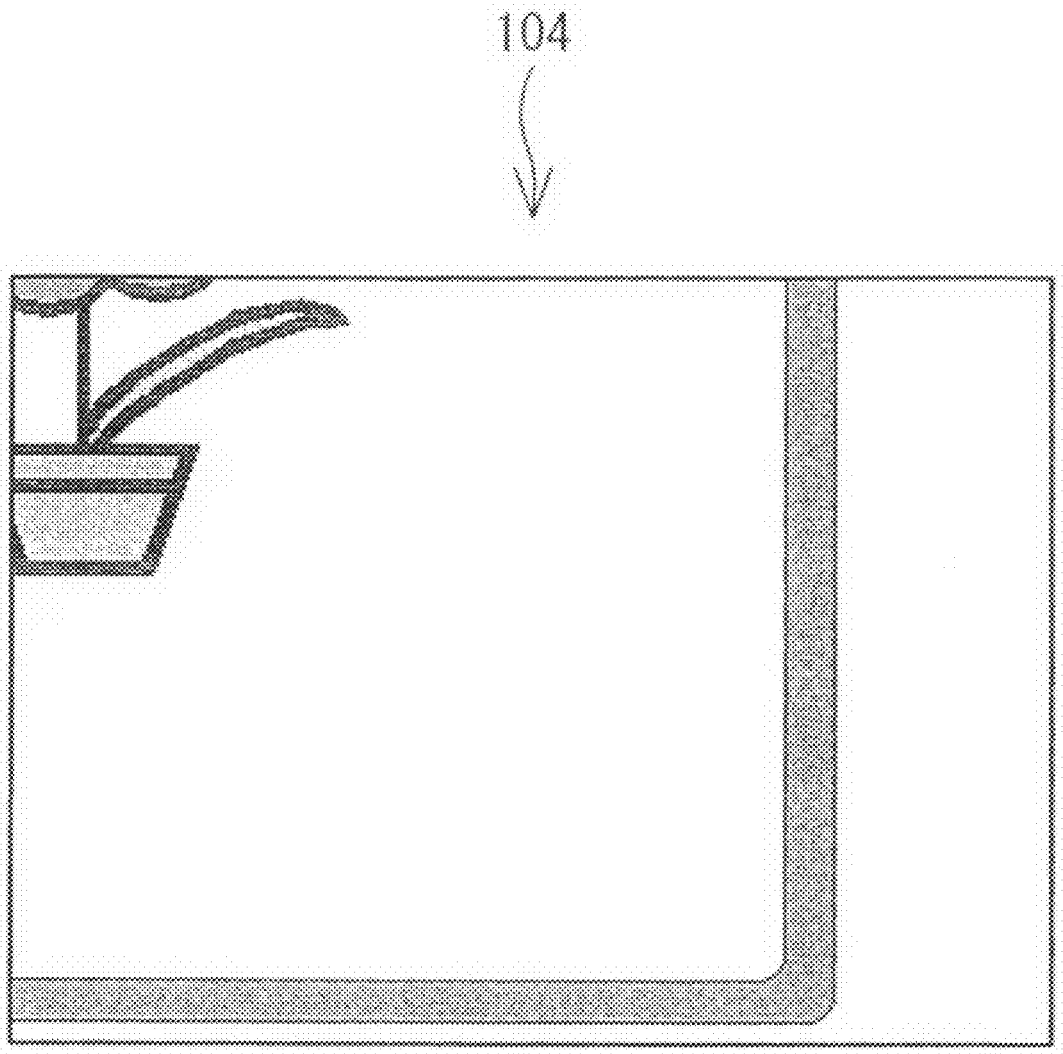
FIG. 16 is a schematic illustration showing a partial image of a right front portion of the embroidery area.

The embroidery frame 34 is moved to a position for an image of the image number "4" (step S2), and then the image is picked up by the image sensor 90 (step S3). The picked up image is stored as a partial image of the image number "4" in the partial image storage area 631 (step S4). The partial image 104 shown in FIG. 16 is an example of the partial image of the image number "4." The example shown in FIG. 16 is a partial image of a right front portion of the embroidery area and the embroidery frame 34 in a case where the picture of the flower is laid out at substantially the middle of the embroidery area in the embroidery frame 34.

Since the variable n is "4," it is determined that all the images have been picked up (YES at step S5). Then, the thickness of a work cloth is detected by the potentiometer 59 (step S7). The thickness of the work cloth is used for correcting the partial images. As described above, the thickness of the work cloth is detected by detecting the position in height of the presser foot 47 with the potentiometer 59. Next, the partial images are corrected (step S8). That is, coordinates (u, v) that indicate a position of each of the pixels of the partial images are converted into three-dimensional coordinates $M_W(X_W, Y_W, Z_W)$ in the world coordinate system. Specifically, for each of the pixels of the partial images, the three-dimensional coordinates $M_W(X_W, Y_W, Z_W)$ in the world coordinate system are calculated with internal parameters and external parameters. The calculated three-dimensional coordinates $M_W(X_W, Y_W, Z_W)$ are stored in the world coordinate storage area 632 of the RAM 63. All the partial images that are stored in the partial image storage area 631 are corrected. The internal and external parameters will be described and then how to calculate the three-dimensional coordinates $M_w(X_w, Y_w, Z_w)$ in the world coordinate system will be described. The EEPROM 64 includes a storage area for the internal parameters, in which the internal parameters are stored, and a storage area for the external parameters, in which the external parameters are stored.

An internal parameter is a parameter to correct a shift in focal length or, a shift in principal point coordinates, or distortion of a picked-up image due to properties of the image sensor 90. A partial image picked up by the image sensor 90 may possibly have the following problems. For example, the center position of the image may be unclear. For example, in a case where pixels of the image sensor 90 are not square-shaped, the two coordinate axes of the image may have different scales. The two coordinate axes of the image may not always be orthogonal to each other. Therefore, the concept of a "normalized camera" may be introduced here. The normalized camera picks up an image at a position that is a unit length away from a focal point in a condition where the two coordinate axes of the image have the same scale and are orthogonal to each other. An image picked up by the image sensor 90 is converted into a normalized image, which is an image that is assumed to have been picked up by the normalized camera. The internal parameters are used for converting the image picked up by the image sensor 90 into the normalized image. In the present embodiment, the following six internal parameters are used: X-axial focal length, Y-axial focal length, X-axial principal point coordinate, Y-axial principal point coordinate, first coefficient of distortion, and second coefficient of distortion. The X-axial focal length is an internal parameter that represents an X-axis directional shift of the focal length of the image sensor 90. The Y-axial focal length is an internal parameter that represents a Y-axis directional shift of the focal length. The X-axial principal point coordinate is an internal parameter that represents an X-axis directional shift of the principal point of the image sensor 90. The Y-axial principal point coordinate is an internal parameter that represents a Y-axis directional shift of the principal point. The first coefficient of distortion and the second coefficient of distortion are internal parameters, which represent distortion due to the inclination of a lens of the image sensor 90.

An external parameter is a parameter that indicates a mounting condition (position and direction) of the image sensor 90 with respect to the world coordinate system. Accordingly, the external parameter indicates a shift of the three-dimensional coordinate system in the image sensor 90 with respect to the world coordinate system. Hereinafter, the three-dimensional coordinate system in the image sensor 90 is referred to as a "camera coordinate system." By using the external parameters, the camera coordinate system of the image sensor 90 can be converted into the world coordinate system. In the present embodiment, the six external parameters are calculated: X-axial rotation vector, Y-axial rotation vector, Z-axial rotation vector, X-axial translation vector, Y-axial translation vector, and Z-axial translation vector. The X-axial rotation vector represents a rotation of the camera coordinate system around the x-axis with respect to the world coordinate system. The Y-axial rotation vector represents a rotation of the camera coordinate system around the y-axis with respect to the world coordinate system. The Z-axial rotation vector represents a rotation of the camera coordinate system around the z-axis with respect to the world coordinate system. The X-axial rotation vector, the Y-axial rotation vector, and the Z-axial rotation vector are used to determine a conversion matrix that is used to convert coordinates in the world coordinate system into coordinates in the camera coordinate system, and vice versa. The X-axial translation vector represents an x-axial shift of the camera coordinate system with respect to the world coordinate system. The Y-axial translation vector represents a y-axial shift of the camera coordinate system with respect to the world coordinate system. The Z-axial translation vector represents a z-axial shift of the camera coordinate system with respect to the world coordinate system. The X-axial translation vector, the Y-axial translation vector, and the Z-axial translation vector are used to determine a translation vector that is used to convert coordinates in the world coordinate system into coordinates in the camera coordinate system, and vice versa.

Description will be made below as to a method of calculating three-dimensional coordinates $M_w(X_w, Y_w, Z_w)$ in the world coordinate system. It is assumed that two-dimensional coordinates of a point p in a partial image are (u, v) and three-dimensional coordinates of the point P in the camera coordinate system are $M_1(X_1, Y_1, Z_1)$. As for the internal parameters, it is assumed that the X-axial focal length is fx, the Y-axial focal length is fy, the X-axial principal point coordinate is cx, the Y-axial principal point coordinate is cy, the first coefficient of distortion is $k_1$, and the second coefficient of distortion is $k_2$. As for the external parameters, it is assumed that the X-axial rotation vector is $r_1$, the Y-axial rotation vector is $r_2$, the Z-axial rotation vector is $r_3$, the X-axial translation vector is $t_1$, the Y-axial translation vector is $t_2$, and the Z-axial translation vector is $t_3$. $R_w$ is a 3×3 rotation matrix that is determined based on the external parameters of X-axial rotation vector $r_1$, Y-axial rotation vector $r_2$, and Z-axial rotation vector $r_3$. $t_w$ is a 3×1 translation vector that is determined based on the external parameters of X-axial translation vector $t_1$, Y-axial translation vector $t_2$, and Z-axial translation vector $t_3$.

First, by using the internal parameters of the X-axial focal length fx, the Y-axial focal length fy, the X-axial principal point coordinate cx, and the Y-axial principal point coordinate cy, coordinates (u, v) of a point in a partial image in the camera coordinate system are converted into coordinates (x", y") in a normalized image in the camera coordinate system. The coordinates (x", y") is obtained as $x''=(u-cx)/fx$ and $y''=(v-cy)/fy$. Subsequently, by using the internal parameters of the first coefficient of distortion $k_1$ and the second coefficient of distortion $k_2$, the coordinates (x", y") are converted into coordinates (x', y') in the normalized image from which lens distortion has been removed. The coordinates (x', y') are obtained as $x'=x''-x''\times(1+k_1\times r^2+k_2\times r^4)$ and $y'=y''-y''\times(1+k_1\times r^2+k_2\times r^4)$. The equation $r^2=x''^2+y''^2$ holds true. The coordinates in the normalized image in the camera coordinate system are converted into three-dimensional coordinates $M_1(X_1, Y_1, Z_1)$ of the point in the camera coordinate system. The equations $X_1=x'\times Z_1$ and $Y_1=y'\times Z_1$ holds true. The equation $M_w=R_w^T(M_1-t_w)$ holds true between the three-dimensional coordinates $M_1(X_1, Y_1, Z_1)$ in the camera coordinate system and the three-dimensional coordinates $M_w(X_w, Y_w, Z_w)$ in the world coordinate system. $R_w^T$ is a transposed matrix of $R_w$. A thickness of the work cloth is taken as $Z_w$. $X_1$, $Y_1$, and $Z_1$ are calculated by solving the simultaneous equations of $X_1=x'\times Z_1$, $Y_1=y'\times Z_1$, and $M_w=R_w^T(M_1-t_w)$, thus the three-dimensional coordinates $M_w(X_w, Y_w, Z_w)$ in the world coordinate system are obtained. Then, $X_w$ and $Y_w$ are stored in the world coordinate storage area 632. The $Z_w$ coordinate need not be stored, because the thickness of the work cloth is supposed to be uniform.

In such a manner, $X_w$ and $Y_w$ corresponding to each of the pixels of the four partial images are stored in the world coordinate storage area 632 (correction is made). Subsequently, the images are combined to generate a composite image (step S9). Specifically, coordinates (x, y) of the composite image, which correspond to the three-dimensional coordinates $M_w(X_w, Y_w, Z_w)$ of a partial images are calculated. Assuming that the embroidery frame coordinates of the partial images to be processed in the embroidery frame coordinate storage area 621 is (a, b), the coordinates (x, y) may be calculated by $x=X_w/\text{scale}+\text{width}/2+a$ and $y=Y_w/\text{scale}+\text{height}/2+b$. Then, the $X_W$ coordinate and the $Y_W$ coordinate of the three-dimensional coordinates $M_w(X_w, Y_w, Z_w)$ are stored in the corresponding arrays corresponding to the calculated coordinates (x, y) of the composite image in the corresponding coordinate storage area 633 (see FIG. 10). The $Z_w$ coordinate need not be stored, because the thickness of the work cloth is supposed to be uniform. With this, by referring to the corresponding coordinate storage area 633, it is possible to identify $(X_w, Y_w)$ which correspond to the coordinates (x, y) of a pixel of the composite image. Furthermore, $(X_w, Y_w)$ are correlated with the coordinates (u, v) of the partial image in the world coordinate storage area 632 shown in FIG. 9. Therefore, by referring to the corresponding coordinate storage area 633 and the world coordinate storage area 632, it is possible to identify the coordinates (u, v) of the partial image corresponding to the coordinates (x, y) of the composite image. If there are a plurality of (u, v) that correspond to $(X_w, Y_w)$, the coordinates of the partial image having a larger image number may be identified as the corresponding coordinates. Then, the pixel value of a pixel having the coordinates (u, v) of the partial image corresponding to the coordinates (x, y) of the composite image is read out from the partial image storage area 631 and stored in (x, y) in the composite image storage area 634 (see FIG. 11).

Figure 17:
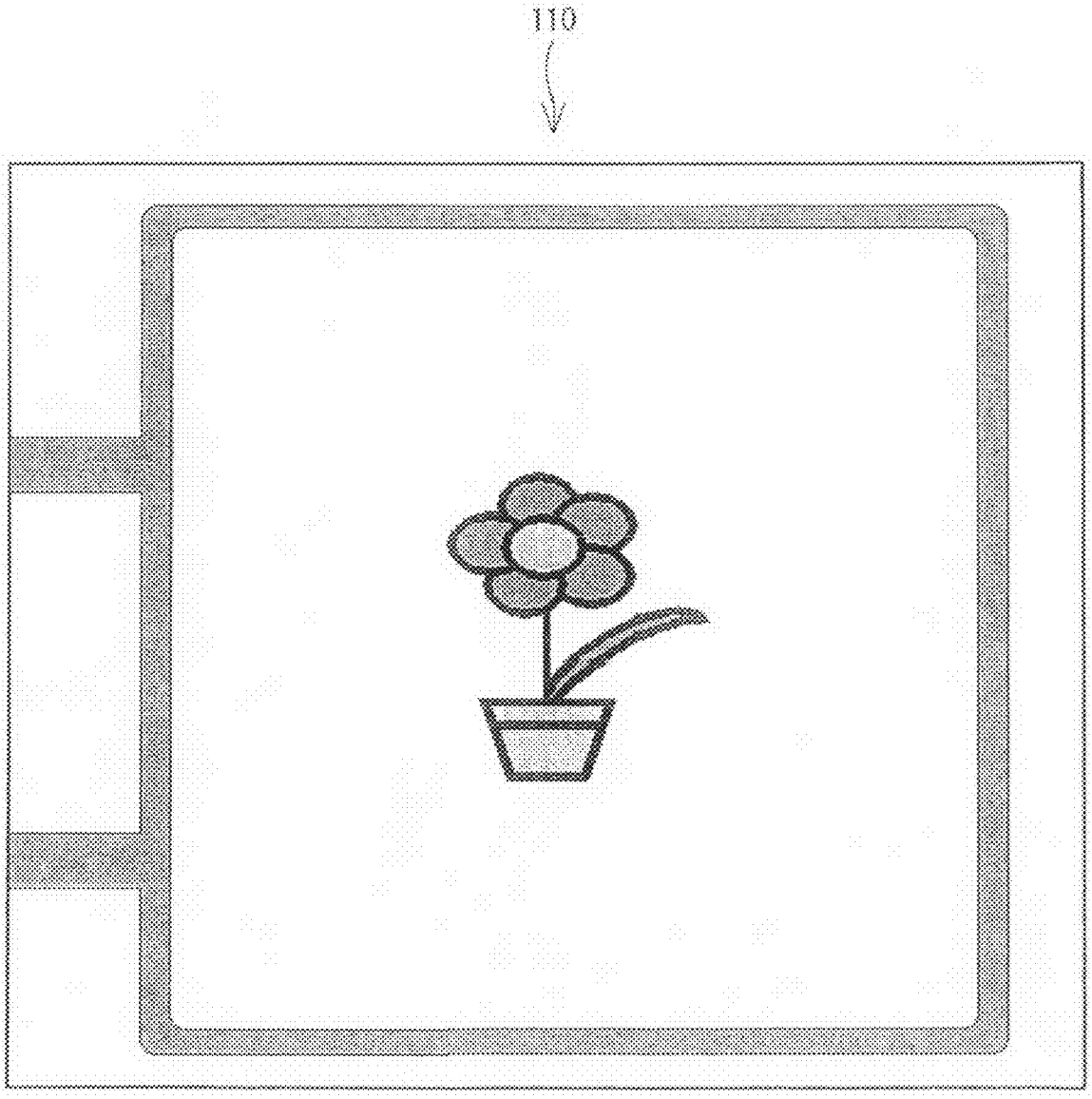
FIG. 17 is a schematic illustration showing a composite image generated by combining the partial images.

In such a manner, a composite image is generated from partial images and then the composite image generation processing is ended. For example, the four partial images 101 to 104 of FIGS. 13 to 16 are combined, so that a composite image 110 shown in FIG. 17 is generated. As described above, a partial image can be acquired by moving the embroidery frame 34 based on the embroidery frame coordinates stored in the embroidery frame coordinate storage area 621 and picking up an image by the image sensor 90. The embroidery frame coordinate storage area 621 stores embroidery frame coordinates (a, b) which are set to enable picking up partial images as many as required to obtain an image of the entire area within the embroidery frame 34. Therefore, by combining the acquired partial images, a composite image can be generated. Accordingly, the image of the entire area within the embroidery frame 34 that cannot be picked up at one time by the image sensor 90 can be acquired by combining a plurality of images. Further, by using the embroidery frame coordinates (a, b) that are used when the embroidery frame 34 is moved, it is possible to calculate which pixel value of any given one of the pixels of the partial image should be used for a pixel value of each of the pixels constituting the composite image. It is therefore possible to easily correlate the pixel of the composite image with the pixel of the partial image. Further, the internal parameters and the external parameters are used to correct the pixels of the partial image into the pixels in the world coordinate system. It is thus possible to obtain beautiful results free of distortion when a composite image is generated.

Next, methods of utilizing a composite image will be described below. In the first method, the composite image may be used as a background image when an embroidery pattern is arranged or edited. In the second method, the composite image may be used to create an embroidery pattern. First, the first method will be described below with reference to FIG. 18. An embroidery edit screen 200 shown in FIG. 18 may be used when the user edits an embroidery pattern to be sewn with the sewing machine 1. Arranged at the upper end of the embroidery edit screen 200 are a utility stitch key 291, a character pattern key 292, an embroidery key 293, and an embroidery edit key 294. Currently, the embroidery edit key 294 is selected on the embroidery edit screen 200. At the left upper half portion of the embroidery edit screen 200, an embroidery result display area 231 is arranged. The embroidery result display area 231 displays results of embroidery. At the right lower part of the embroidery result display area 231, an embroidery thread display area 251 is arranged. The embroidery thread display area 251 indicates a color of an embroidery thread to be used in embroidery. Above the embroidery thread display area 251, a thread-color-specific embroidery result display area 232 is arranged. The thread-color-specific embroidery result display area 232 displays an embroidery result of an embroidery thread selected in the embroidery thread display area 251. At the lower half of the embroidery edit screen 200, an edit instruction key area 210 may be arranged. The edit instruction key area 210 is used when issuing a variety of instructions on the embroidery results displayed in the embroidery result display area 231 may be entered.

The edit instruction key area 210 includes positioning keys 211, a repeat key 212, a vertical/horizontal text direction key 213, a rotation key 214, a size key 215, a thread density key 216, a horizontal mirror image key 217, a spacing key 218, an array key 219, a multi color key 220, and a color palette key 221. The positioning keys 211 are used for determining the layout of an embroidery pattern. The repeat key 212 is used for repeatedly displaying an embroidery pattern. The vertical/horizontal text direction key 213 is used for switching between vertical writing and horizontal writing. The rotation key 214 is used for rotating an embroidery pattern. The size key 215 is used for changing the size of an embroidery pattern. The thread density key 216 is used for changing the thread density of an embroidery pattern. The horizontal mirror image key 217 is used for flipping an embroidery pattern horizontally. In a case where the horizontal mirror image key 217 is selected, an embroidery pattern displayed in the embroidery result display area 231 may be flipped horizontally. The spacing key 218 is used for changing the character spacing of a character string. The array key 219 is used when changing the array of characters. The multi color key 220 is used for specifying the color for each character. The thread palette key 221 is used for changing the color (embroidery thread) of an embroidery pattern.

In a case where the repeat key 212, the rotation key 214, the size key 215, the spacing key 218, the array key 219, the multi color key 220, or the thread palette key 221 is selected, a key for further detailed instruction may appear in the edit instruction key area 210. For example, in a case where the size key 215 is selected, there may appear an enlargement key, a reduction key, a horizontal enlargement key, a horizontal reduction key, a vertical enlargement key, and a vertical reduction key. The enlargement key is used for enlarging a size of an embroidery pattern without changing the height-to-width proportion. The reduction key is used for reducing the size of the embroidery pattern without changing the height-to-width proportion. The horizontal enlargement key is used for horizontally enlarging the size of the embroidery pattern. The horizontal reduction key is used for horizontally reducing the size of the embroidery pattern. The vertical enlargement key is used for vertically enlarging the size of the embroidery pattern. The vertical reduction key is used for vertically reducing the size of the embroidery pattern. In a case where the rotation key 214 is selected, there may appear a left-90 key, a right-90 key, a left-10 key, a right-10 key, a left-1 key, a right-1 key, and a reset key. The left-90 key is used for rotating the embroidery pattern by 90 degrees counterclockwise. The right-90 key is used for rotating the embroidery pattern by 90 degrees clockwise. The left-10 key is used for rotating the embroidery pattern by 10 degrees counterclockwise. The right-10 key is used for rotating the embroidery pattern by 10 degrees clockwise. The left-1 key is used for rotating an embroidery pattern by 1 degree counterclockwise. The right-1 key is used for rotating the embroidery pattern by 1 degree clockwise. The reset key is used for returning the embroidery pattern to the original angle of the embroidery pattern. In such a manner, by selecting a key suitable for the user's editing purpose, the user can perform various kinds of editing so that the embroidery pattern may be moved, rotated, or enlarged, for example.

A delete key 222 is arranged below the edit instruction key area 210. If the delete key 222 is selected, an embroidery pattern that is being displayed in the embroidery result display area 231 is deleted. To display an embroidery pattern in the embroidery result display area 231, the user may perform the following operations. If the user selects a character pattern stitch key 292 or an embroidery key 293, a character pattern stitch screen (not shown) or an embroidery pattern selection screen (not shown) is displayed. On the character pattern stitch screen, the user can enter a desired character to be embroidered. If the embroidery edit key 294 is selected to display the embroidery edit screen 200, the entered character is displayed as an embroidery result on the embroidery result display area 231. On the embroidery pattern selection screen, the embroidery result display area 231 is arranged in the same area as the embroidery edit screen 200. Embroidery patterns stored beforehand in the RAM 63 of the sewing machine 1 are displayed in the edit instruction key area 210 so that any one of the displayed embroidery patterns may be selected. The selected pattern is displayed in the embroidery result display area 231.

Figure 18:
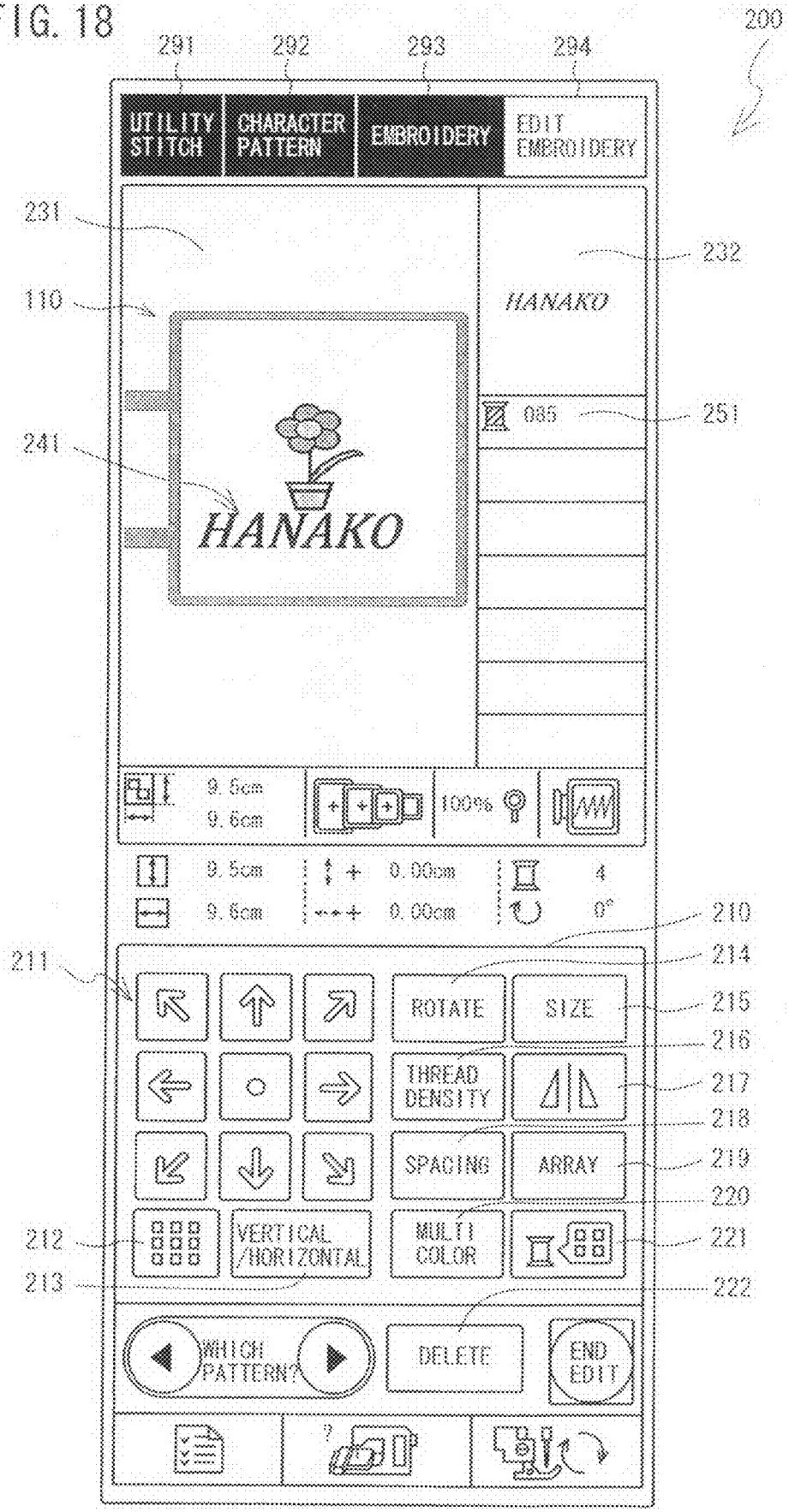
FIG. 18 is a schematic illustration showing an embroidery edit screen.

In the embroidery result display area 231, as shown in FIG. 18, the composite image 110 (the embroidery frame 34 and the picture of the flower) is displayed as a background. The embroidery frame 34 is shown as a simplified rectangle. For example, the characters "HANAKO" (an embroidery pattern 241) are displayed as an embroidery pattern. In such a case, the user may arrange the embroidery pattern 241 as checking a condition of a work cloth that is actually set in the embroidery frame that is displayed on the LCD 15. In an example shown in FIG. 18, the embroidery pattern 241 is arranged below the flower picture. Accordingly, the user may consider a case where the embroidery pattern 241 is arranged above the flower picture, a case where the embroidery pattern 241 is arranged beside the flower picture or the like. Further, the user may check a character size that is well-balanced. For example, if the size key 215 is touched, various instruction keys are displayed. If a position on the touch panel 26 corresponding to a position of the enlargement key is touched, the size of the embroidery pattern 241 displayed in the embroidery result display area 231 is enlarged. Such a configuration may be employed that it may be selected by the user whether the composite image 110 is displayed in the embroidery result display area 231. In such a case, for example, a background display key might well be displayed on the embroidery edit screen 200 or the embroidery pattern selection screen. If the background display key is selected, a composite image that is stored in the composite image storage area 634 may be displayed. When the background display key is selected, the above-mentioned composite image generation processing (see FIG. 12) may be performed to generate a composite image.

In such a manner, as a composite image that shows an embroidery frame for actual embroidering is displayed, it may be convenient for the user to consider the size or balance of the embroidery pattern in a case where the user determines the position of an embroidery pattern or edits the embroidery pattern.

Next, the second method of creating embroidery data by using a composite image will be described below with reference to the flowchart of FIG. 19. If a position on the touch panel 26 which corresponds to an embroidery data creation key on an initial menu screen (not shown), that is displayed on the LCD 15 is touched, the CPU 61 executes an embroidery data creation program to perform embroidery data creation processing shown in FIG. 19. The embroidery data creation program is stored beforehand in the ROM 62 of the sewing machine 1. An instruction of creating embroidery data may not be received by accepting an input from the touch panel 26. For example, an embroidery data creation switch may be provided on the arm 13 so that the instruction of creating embroidery data may be received by pressing the embroidery data creation switch.

Figure 19:
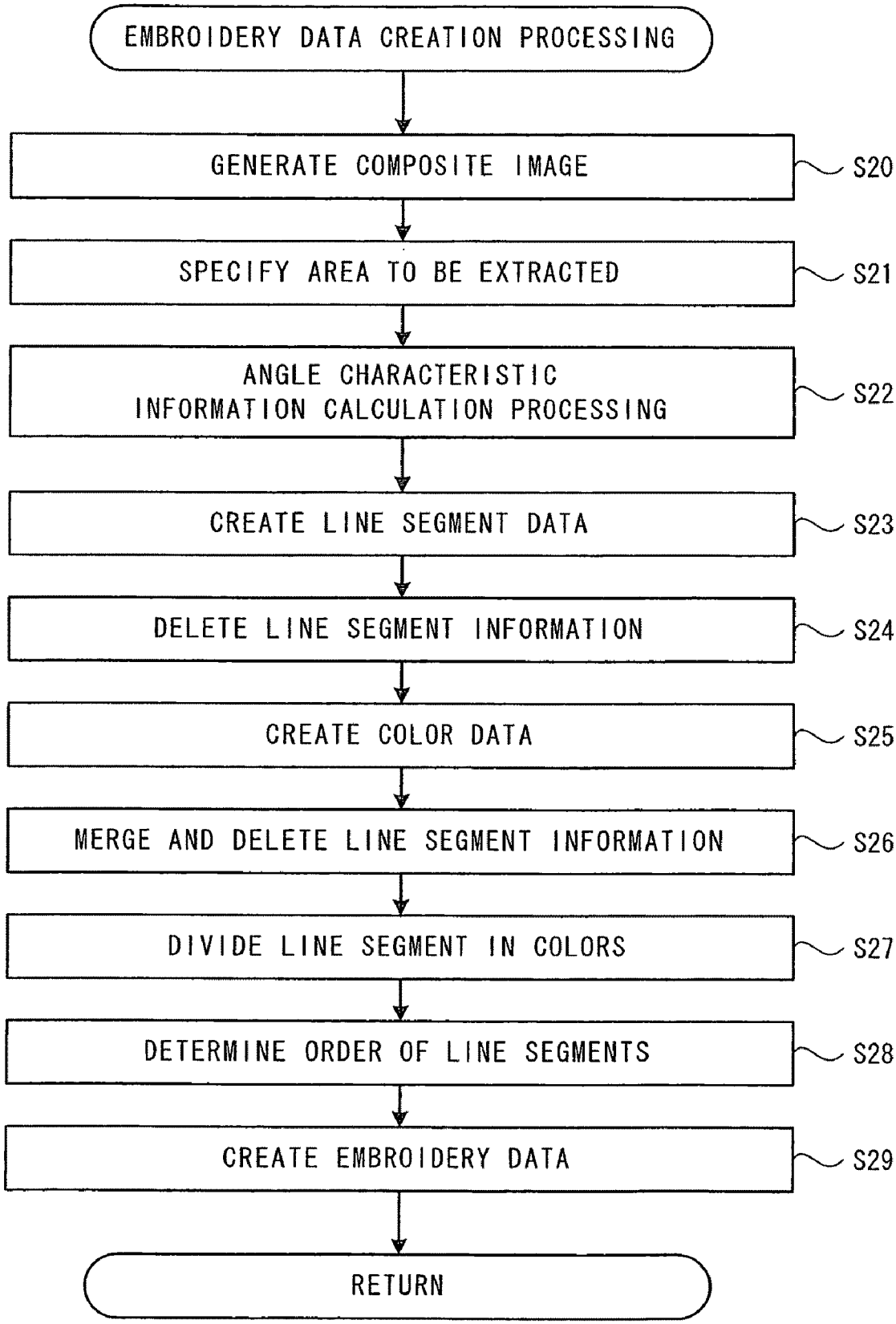
FIG. 19 is a flowchart showing processing to create embroidery data.

As shown in FIG. 19, first, a composite image is generated (step S20). The composite image generation processing is performed as described above with reference to FIG. 12, so that the pixel value of each of pixels of the generated composite image is stored in the composite image storage area 634. Subsequently, the specification of an extraction area that includes an embroidery pattern is accepted (step S21). Specifically, the composite image is displayed on the LCD 15. The user encloses on the touch panel 26 an area in which a desired embroidery pattern is shown, with the user's finger, to specify the area. The CPU 61 of the sewing machine 1 extracts pixels that is included in an area of the composite image which is displayed on the LCD 15 and corresponds to the area specified on the touch panel 26 as the pixels to constitute an image that is used for creating the embroidery pattern, thereby creating the image that is used for creating the embroidery pattern. Hereinafter, the image that is used for creating an embroidery pattern is referred to as an "embroidery image." The created embroidery image is stored in a predetermined storage area in the RAM 63.

Embroidery data is created from the embroidery image with a known technique of creating image embroidery data (step S22 to step S29). First, an angle characteristic and an angle characteristic intensity of each of the pixels of the embroidery image are calculated (step S22). The angle characteristic is a value that indicates a direction in which the continuity of a color is high. The angle characteristic intensity is a value that indicates the intensity of color continuity. When the angle characteristic and the angle characteristic intensity are calculated, an embroidery image is transformed into a gray scale image and brightness values of surrounding pixels are used. The surrounding pixels refer to pixels that surround a target pixel of which the angle characteristic and the angle characteristic intensity are to be calculated. Hereinafter, the angle characteristic and the angle characteristic intensity is referred to as "angle characteristic information." The calculated angle characteristic information is stored in a predetermined storage area in the RAM 63.

Subsequently, line segment data is created from the angle characteristic information (step S23). Here, line segment information including an angle component and a length component is created for each of the pixels. A set of pieces of the line segment information created from the angle characteristic information is line segment data. An angle characteristic is set as is the angle component. A predetermined fixed value or a value inputted by the user is set as the length component. In a case where line segment information is created for all pixels of an image and embroidery sewing is performed in accordance with embroidery data created on the basis of the line segment data, the sewing quality may be damaged. For example, stitches may extremely abound or stitches may be repeatedly sewn at the same position on the work cloth. Therefore, the line segment information may be created only for pixels that have a larger angle characteristic intensity than a threshold value.

Subsequently, a piece of the line segment information that is inappropriate or unnecessary in creating embroidery data is deleted (step S24). Specifically, all the pixels of the image are sequentially scanned from a pixel at the upper left and the processing below is performed on all the pixels for which the line segment information has been created. First, in a case where any of the surrounding pixels have line segment information having an angle similar to an angle of line segment information of the target pixel, whichever line segment information having the smaller angle characteristic intensity is deleted.

Next, color data of each of the line segments is created (step S25). Image data and the line segment data are used to create the color data that indicates a color component of the line segment. A reference area is set when a line segment identified by the line segment information created for the target pixel is drawn in a transformed image. RGB values of each of the pixels that are included in the reference area are used, so that RGB values of the reference area may be calculated. A thread color having the RGB values that are closest to the calculated RGB values is selected from among thread colors that can be used in the sewing machine 1 and determined as the color of the line segment.

After the color data is thus created, each of the pieces of the line segment information to which the color component is added is analyzed again and some pieces of the line segment information in the line segment data are merged or deleted (step S26). In a case where the line segments identified by respective pieces of line segment data includes line segments that have the same color and are superimposed on each other on the same line, that is, in a case where two or more line segments that have the same angle component and the same color component and are partially superimposed on each other, pieces of line segment data for the superimposed line segments are merged into a piece of line segment data.

Subsequently, the pieces of the line segment data is divided in colors (step S27). Hereinafter, the line segment data that is divided in color is referred to as "color line segment data." Color data indicates a color component of each of the line segments, which constitute the line segment data. Accordingly, a set of line segments (line segment group) is created for each of the color components. Subsequently, the order of the line segments is determined for each piece of the color line segment data (step S28). Specifically, a line segment that has an end point at the upper leftmost position is extracted from among the line segments indicated by the color line segment data that determines the order. The extracted line segment is supposed to be a starting line segment, that is, a first line segment. The end point of the line segment at the leftmost position is supposed to be a starting point and the other end point of the line segment having the starting point is supposed to be a terminal point. A line segment having an end point that is closest to the terminal point is extracted. The extracted line segment is supposed to be a second line segment. An end point closest to a terminal point of an immediately previous line segment is supposed to be a starting point of a next line segment and the other end point of the second line segment is supposed to be a terminal point. Then, a line segment having an extreme point closest to the terminal point is extracted and the extracted line segment is supposed to be a next line segment. Such processing may be repeated. The line segment closest to the line segment having the determined order is determined to be a next line segment until orders of all the line segments are determined. Such processing may be performed on all pieces of the color line segment data.

A line segment that constitute the color line segment data corresponds to stitches in sewing, and stitches are sewn with a running stitch. The stitches are sewn in the order determined at step S28. For example, if the terminal point of a line segment (target line segment) corresponds to the starting point of the line segment (next line segment) that follows the target line segment in the order, stitches are continued. Therefore, the continuous two stitches are sewn with a running stitch. However, if the terminal point of the line segment of interest does not correspond to the starting point of the next line segment, the stitches are not continued. Therefore, the stitch corresponding to the target line segment is sewn with a running stitch and the terminal point of the line segment of interest is connected with the starting point of the next line segment with a jump stitch, then the next line segment is sewn with a running stitch.

For each piece of the line segment data, that is, for each of embroidery threads, embroidery data is created based on the order of line segments indicated by the line segment data. The created embroidery data is stored in a predetermined storage area in the RAM 63 (step S29).

It is thus possible to take a target shown in a composite image as an embroidery pattern. Therefore, a pattern that is printed on or woven into a work cloth beforehand may be sewn as an embroidery pattern. For example, in a case where a work cloth has such a design that the same pattern may be repeatedly arranged, it is possible to add an accent to the design by embroidering only a specific one of the patterns. After the user draws the desired embroidery pattern on a work cloth by hand or prints the embroidery pattern on the work cloth with a thermal transfer sheet or the like, a composite image may be generated to create embroidery data. Further, the design options may be increased in a case where the color or size of an embroidery pattern is changed by using the above-described embroidery pattern edit function.

The sewing machine of the present disclosure is not limited to the above embodiment but of course may be changed variously without departing from the gist of the present disclosure. For example, the embodiment acquires four partial images of the embroidery frame 34. However, the number of the partial images used to generate a composite image is not limited to four. The number of the partial images may be determined by the size of the embroidery frame 34 and the imaging range of the image sensor 90. As many partial images as required to obtain an image of the entire area of the embroidery frame 34 may be picked up by the image sensor 90. If imaging range of an image sensor is larger than the imaging range of the image sensor 90 of the embodiment, fewer partial images may be required. If the imaging range of the image sensor is smaller, more partial images may be required. If an embroidery frame is larger than the embroidery frame 34 of the embodiment, more partial images may be required. If the embroidery frame is smaller than the embroidery frame 34, fewer partial images may be required.

In the embodiment, only one embroidery frame 34 is described. However, a plurality of types of embroidery frames, which are different in size and shape, are usually provided. Each of the plurality of embroidery frames may be attached to the embroidery unit 30. Therefore, embroidery frame coordinates for each of the embroidery frames may be stored in the embroidery frame coordinate storage area 621 (see FIG. 7), so that partial images may be acquired corresponding to the embroidery frame that is currently mounted. A detection unit (not shown) may be provided to detect the type of the embroidery frame attached to the embroidery unit 30. Such a configuration may be possible that partial images may be automatically acquired corresponding to the embroidery frame type detected by the detection unit. For example, Japanese Laid-Open Patent Publication No. 2002-52283 discloses a detection unit, the relevant portions of which are incorporated by reference. Specifically, a plurality of detection switches may be provided on the carriage of the embroidery unit 30 and a plurality of pressing portions for pressing the detection switches may be provided on the guide portion 341 of the embroidery frame 34. Thus, a type of each of the embroidery frames may be detected by a shape of a pressing portion specific to the each of the embroidery frames.

In the embodiment, for generating a composite image, the embroidery frame coordinates (a, b) are used to calculate which pixel of the composite image corresponds to which pixel of the partial images. However, for generating a composite image, the embroidery frame coordinates (a, b) may not be used. For example, a known image matching technique may be used to detect an area that is common to some of the partial images, regard the common area as superimposed, and generate the composite image. In the embodiment, the partial images are corrected with the internal parameters and the external parameters. However, the partial images may not be corrected. The picked-up partial images may be used without correction, to generate a composite image.

Figure 20:
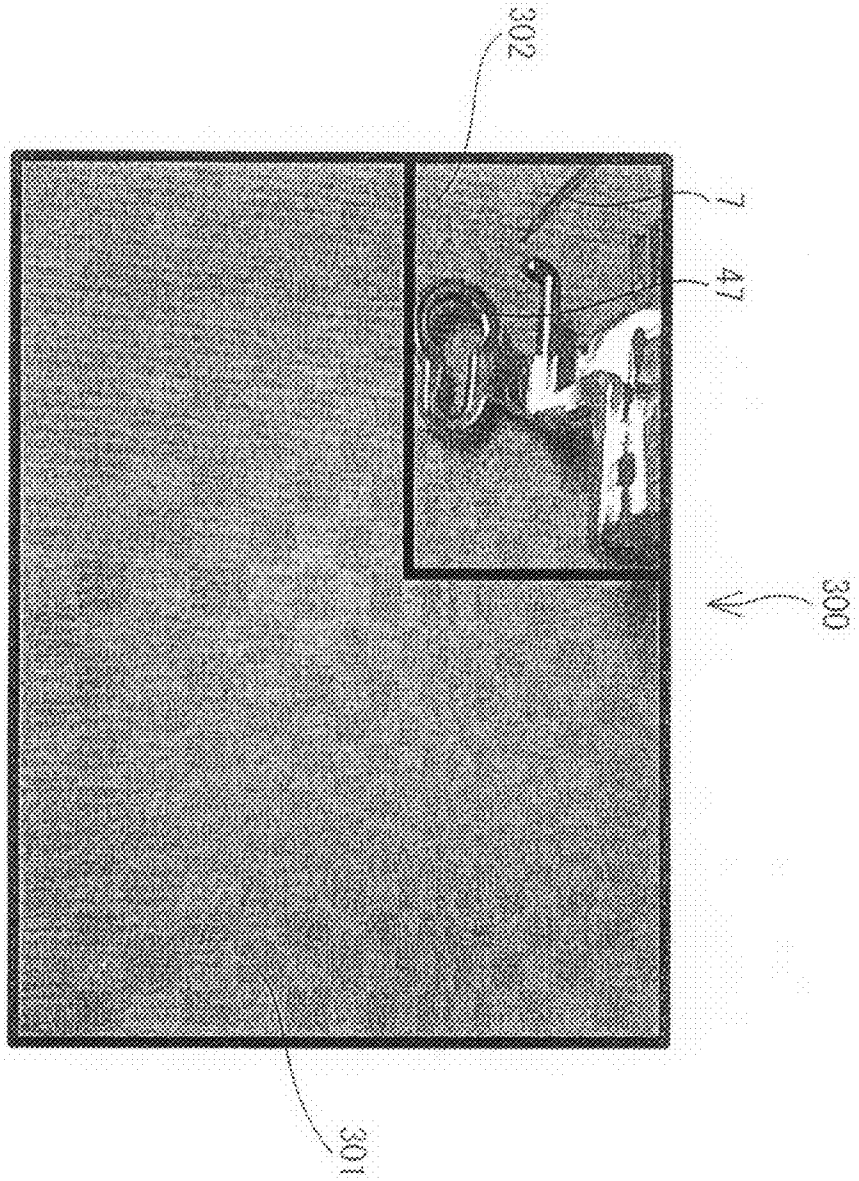
FIG. 20 is an example of the partial image showing some parts of the sewing machine.

In a case where an image is picked up by the image sensor 90, a part such as the presser foot 47 and the sewing needle 7 may be picked up as shown in FIG. 20. FIG. 20 shows an example of a partial image 300 in which parts such as the presser foot 47 and the sewing needle 7 are shown. In such a case, there is a possibility that a composite image generated by combining the partial images may include a portion where the parts are shown. Accordingly, the embroidery frame coordinates (a, b) may be set so that an area in which the parts are shown (an area 302 shown in FIG. 20), that is, an area of a work cloth that is positioned under the parts may be arranged at an area (an area 301 shown in FIG. 20) of another partial image in which no parts are shown. Then, when the pixels of the partial images are correlated with the pixels of the composite image, the pixels of the area 301 in which none of the parts is shown may be correlated with pixels of the composite image. When the pixels of the partial image 300 are correlated with the pixels of the composite image, a composite image may be generated with only the pixels of the area 301 in which none of the parts is shown. Accordingly, for generating a composite image, not all of the areas of the partial images need to be used. A composite image may be generated with only the area in which none of the parts is shown. Similarly, a composite image in which the embroidery frame 34 is not shown may be generated by removing an area in which the embroidery frame 34 is shown.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A sewing machine comprising:

an embroidery frame moving device that moves an embroidery frame holding a work cloth;

an image pickup device that picks up images of an upper surface of a bed portion of the sewing machine;

a position information storage device that stores position information indicating respective predetermined positions to which the embroidery frame is to be moved;

a partial image acquisition device that:

causes the embroidery frame moving device to move the embroidery frame to the respective predetermined positions indicated by the position information, causes the image pickup device to pick up images at the respective predetermined positions, and acquires the images picked up by the image pickup device as partial images; and a composite image generation device that generates a composite image by correcting, based on a thickness of the work cloth, the partial images acquired by the partial image acquisition and combining the partial images that have been corrected.

2. The sewing machine according to claim 1, further comprising:

a parameter storage device that stores a parameter to be used for adjusting the images picked up by the image pickup device; and a partial image adjustment device that adjusts the partial images by using the parameter stored in the parameter storage device.

3. The sewing machine according to claim 1, wherein the composite image generation device generates the composite image by using at least a part of the respective partial images.

4. The sewing machine according to claim 1, wherein the composite image generation device generates the composite image by combining the partial images based on the predetermined positions stored in the position information storage device.

5. The sewing machine according to claim 1, further comprising:

a display device that displays the image;

a first display control device that displays at least a part of an embroidery area and an embroidery pattern on the display device, the embroidery pattern being a pattern to be embroidered, and the embroidery area being an area in which embroidery sewing can be performed and the composite image is displayed as a background;

an embroidery position specification device that specifies a position as an embroidery position in the at least a part of the embroidery area displayed on the display device, the embroidery position being a position on the work cloth at which the embroidery pattern is to be arranged;

a second display control device that displays the embroidery pattern at the embroidery position specified in the at least a part of the embroidery area in which the composite image is displayed as the background; and an embroidery data changing device that changes embroidery data based on the embroidery position of the embroidery pattern displayed on the display device, the embroidery data being prepared beforehand for embroidering the embroidery pattern.

6. The sewing machine according to claim 5, further comprising an embroidery pattern edit instructing device that instructs at least one edit operation of enlarging, reducing, rotating, flipping, and transforming on the embroidery pattern arranged in the at least a part of the embroidery area displayed with the composite image as the background on the display device.

7. The sewing machine according to claim 1, further comprising an embroidery data creation device that creates embroidery data for embroidering a target shown in the composite image.

8. The sewing machine according to claim 1, wherein the image pickup device is a CMOS image sensor.

9. A non-transitory computer-readable medium storing a computer-executable control program executable on a sewing machine, the program comprising instructions for:

moving an embroidery frame holding a work cloth to respective predetermined positions that are indicated by position information and to which the embroidery frame is to be moved;

acquiring images picked up at the respective predetermined positions as partial images; and generating a composite image by correcting, based on a thickness of the work cloth, the partial images acquired and combining the partial images that have been corrected.

10. The non-transitory computer-readable medium according to claim 9, wherein the program further comprises instructions for adjusting the partial images by using a parameter for adjusting the picked up image.

11. The non-transitory computer-readable medium according to claim 9, wherein the composite image is generated by using at least a part of the respective partial images.

12. The non-transitory computer-readable medium according to claim 9, wherein the composite image is generated by combining the partial images based on the predetermined positions.

13. The non-transitory computer-readable medium according to claim 9, wherein the program further comprises instructions for:

displaying at least a part of an embroidery area and an embroidery pattern, the embroidery pattern being a pattern to be embroidered, and the embroidery area being an area in which embroidery sewing can be performed and the composite image is displayed as a background;

receiving a specification that specifies a position as an embroidery position in the at least a part of the embroidery area displayed, the embroidery position being a position on the work cloth at which the embroidery pattern is to be arranged;

displaying the embroidery pattern at the specified embroidery position in the at least a part of the embroidery area in which the composite image is displayed as the background; and changing embroidery data prepared beforehand for embroidering the embroidery pattern, based on the embroidery position of the embroidery pattern displayed.

14. The non-transitory computer-readable medium according to claim 13, wherein the program further comprises instructions for receiving an instruction that instructs at least one edit operation of enlarging, reducing, rotating, flipping, and transforming on the embroidery pattern arranged in the at least a part of the embroidery area displayed with the composite image as the background.

15. The non-transitory computer-readable medium according to claim 9, wherein the program further comprises instructions for creating embroidery data for embroidering a target shown in the composite image.

* * * * *